US011428126B2

(12) United States Patent
Mitsutani

(10) Patent No.: US 11,428,126 B2
(45) Date of Patent: Aug. 30, 2022

(54) VALVE TIMING ADJUSTMENT DEVICE

(71) Applicant: DENSO CORPORATION, Kariya (JP)

(72) Inventor: Tetsuro Mitsutani, Kariya (JP)

(73) Assignee: DENSO CORPORATION, Kariya (JP)

( * ) Notice: Subject to any disclaimer, the term of this patent is extended or adjusted under 35 U.S.C. 154(b) by 0 days.

(21) Appl. No.: 17/411,502

(22) Filed: Aug. 25, 2021

(65) Prior Publication Data

US 2021/0381403 A1 Dec. 9, 2021

Related U.S. Application Data

(63) Continuation of application No. PCT/JP2020/005797, filed on Feb. 14, 2020.

(30) Foreign Application Priority Data

Feb. 28, 2019 (JP) ..... JP2019-035190

(51) Int. Cl.
*F01L 1/34* (2006.01)
*F01L 1/344* (2006.01)
*F02D 13/02* (2006.01)

(52) U.S. Cl.
CPC ..... *F01L 1/3442* (2013.01); *F02D 13/0207* (2013.01)

(58) Field of Classification Search
CPC ..... F01L 1/3442; F01L 1/34409; F01L 2001/34433; F01L 2001/3444; F01L 2001/34453; F01L 2001/34473; F01L 2250/02; F01L 2250/04; F01L 2301/00; F01L 2820/01; F02D 13/0207
See application file for complete search history.

(56) References Cited

U.S. PATENT DOCUMENTS

2019/0323392 A1 10/2019 Mitsutani

FOREIGN PATENT DOCUMENTS

JP 2012-122453 6/2012
WO WO-2018135586 A1 * 7/2018 ..... F01L 1/344

* cited by examiner

*Primary Examiner* — Zelalem Eshete
(74) *Attorney, Agent, or Firm* — Nixon & Vanderhye P.C.

(57) ABSTRACT

A drain port of a hydraulic oil controller is connected to an oil discharge portion. Each of partitions partitions between a corresponding one of drain oil passages and a corresponding one of a retard supply oil passage and an advance supply oil passage. Each of the drain oil passages connects between the oil discharge portion and a corresponding one of a retard chamber and an advance chamber. A recycle oil passage connects between: a portion of each drain oil passage located between the corresponding partition and the drain port; and the retard supply oil passage or the advance supply oil passage. A drain flow restrictor is formed in the portion of each drain oil passage located between the corresponding partition and the drain port. A passage cross-sectional area of the drain flow restrictor is smaller than a smallest passage cross-sectional area of the recycle oil passage and is constant.

8 Claims, 10 Drawing Sheets

VALVE TIMING ADJUSTMENT DEVICE

CROSS REFERENCE TO RELATED APPLICATIONS

This application is a continuation application of International Patent Application No. PCT/JP2020/005797 filed on Feb. 14, 2020, which designated the U.S. and claims the benefit of priority from Japanese Patent Application No. 2019-035190 filed on Feb. 28, 2019. The entire disclosures of all of the above applications are incorporated herein by reference.

TECHNICAL FIELD

The present disclosure relates to a valve timing adjustment device.

BACKGROUND

There is known a valve timing adjustment device that is installed in a drive force transmission path for transmitting a drive force from a drive shaft to a driven shaft of an internal combustion engine and adjusts a valve timing of valves that are driven to open and close by the driven shaft.

In a case where the valve timing adjustment device is a hydraulic type, the valve timing adjustment device includes: a housing that is rotated synchronously with one of the drive shaft and the driven shaft; and a vane rotor that is fixed to an end portion of the other one of the drive shaft and the driven shaft. The valve timing adjustment device rotates the vane rotor in a retarding direction or an advancing direction by supplying hydraulic oil to retard chambers or advance chambers defined by the vane rotor in the inside of the housing. The hydraulic oil to be supplied to the retard chambers and the advance chambers is controlled by a hydraulic oil control valve.

SUMMARY

This section provides a general summary of the disclosure, and is not a comprehensive disclosure of its full scope or all of its features.

According to the present disclosure, there is provided a valve timing adjustment device configured to adjust a valve timing of a valve of an internal combustion engine. The valve timing adjustment device includes a phase shifter and a hydraulic oil controller. The phase shifter includes a retard chamber and an advance chamber. The hydraulic oil controller is configured to control a flow of hydraulic oil supplied to the retard chamber and the advance chamber by controlling the hydraulic oil flowing in a retard supply oil passage, which connects between a hydraulic oil supply source and the retard chamber, and the hydraulic oil flowing in an advance supply oil passage, which connects between the hydraulic oil supply source and the advance chamber. The hydraulic oil controller includes a drain port, a partition, a recycle oil passage and a drain flow restrictor. The drain port is connected to an oil discharge portion that is configured to store the hydraulic oil discharged from the retard chamber or the advance chamber. The partition is configured to partition between a drain oil passage and a corresponding one of the retard supply oil passage and the advance supply oil passage. The drain oil passage connects between the oil discharge portion and a corresponding one of the retard chamber and the advance chamber. The recycle oil passage connects between: a portion of the drain oil passage located between the partition and the drain port; and the retard supply oil passage or the advance supply oil passage. The drain flow restrictor is formed in the drain oil passage at a location between the partition and the drain port. A passage cross-sectional area of the drain flow restrictor is smaller than a smallest passage cross-sectional area of the recycle oil passage and is constant.

BRIEF DESCRIPTION OF DRAWINGS

The drawings described herein are for illustrative purposes only of selected embodiments and not all possible implementations, and are not intended to limit the scope of the present disclosure.

DETAILED DESCRIPTION

Figure 1:
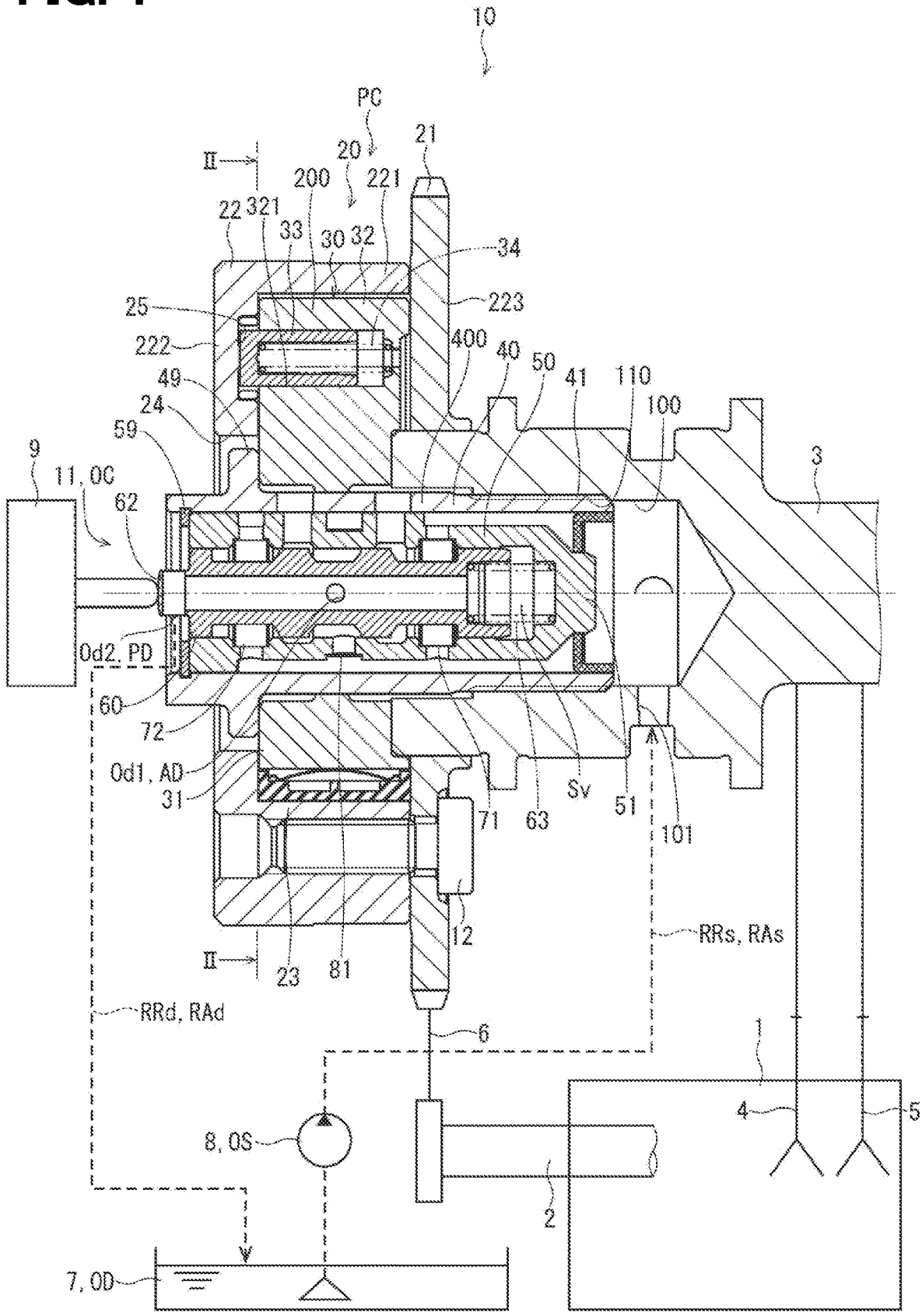
FIG. 1 is a cross-sectional view of a valve timing adjustment device according to a first embodiment.

There is known a valve timing adjustment device that is installed in a drive force transmission path for transmitting a drive force from a drive shaft to a driven shaft of an internal combustion engine and adjusts a valve timing of valves that are driven to open and close by the driven shaft.

In a case where the valve timing adjustment device is a hydraulic type, the valve timing adjustment device includes: a housing that is rotated synchronously with one of the drive shaft and the driven shaft; and a vane rotor that is fixed to an end portion of the other one of the drive shaft and the driven shaft. The valve timing adjustment device rotates the vane rotor in a retarding direction or an advancing direction by supplying hydraulic oil to retard chambers or advance chambers defined by the vane rotor in the inside of the housing. The hydraulic oil to be supplied to the retard chambers and the advance chambers is controlled by a hydraulic oil control valve.

For example, in a previously proposed valve timing adjustment device, the hydraulic oil control valve is configured to control flow of the hydraulic oil supplied to the retard chambers and the advance chambers by controlling the hydraulic oil flowing in a retard supply oil passage, which connects between a hydraulic oil supply source and the retard chambers, and the hydraulic oil flowing in an advance supply oil passage, which connects between the hydraulic oil supply source and the advance chambers. The hydraulic oil control valve includes a drain port, a partition and a recycle oil passage.

The drain port is connected to an oil discharge portion that is configured to store the hydraulic oil discharged from the retard chambers or the advance chambers. The partition partitions between: a drain oil passage which connects between the retard chambers or the advance chambers and the oil discharge portion; and the retard supply oil passage or the advance supply oil passage. The recycle oil passage connects between: a portion of the drain oil passage located between the partition and the drain port; and the retard supply oil passage or the advance supply oil passage. With this configuration, the hydraulic oil can be reused by re-supplying a portion of the hydraulic oil, which is discharged from the advance chambers or the retard chambers and flows in the drain oil passage, to the retard chambers or the advance chambers through the recycle oil passage.

Furthermore, in the previously proposed valve timing adjustment device, the hydraulic oil control valve includes a drain flow restrictor formed in the drain oil passage at a location between the partition and the drain port. Here, a passage cross-sectional area of the drain flow restrictor is relatively large. Therefore, the amount of the hydraulic oil discharged to the oil discharge portion through the drain flow restrictor may possibly be increased, and the amount of the hydraulic oil resupplied to the retard chambers or the advance chambers through the recycle oil passage may possibly be reduced. Therefore, responsiveness of the valve timing adjustment device may possibly be deteriorated.

According to the present disclosure, there is provided a valve timing adjustment device configured to adjust a valve timing of a valve of an internal combustion engine. The valve timing adjustment device includes a phase shifter and a hydraulic oil controller.

The phase shifter includes a retard chamber and an advance chamber. The phase shifter is configured to adjust the valve timing of the valve by shifting a rotational phase between a drive shaft and a driven shaft of the internal combustion engine with hydraulic oil supplied from a hydraulic oil supply source to the retard chamber and the advance chamber.

The hydraulic oil controller is configured to control a flow of the hydraulic oil supplied to the retard chamber and the advance chamber by controlling the hydraulic oil flowing in a retard supply oil passage, which connects between the hydraulic oil supply source and the retard chamber, and the hydraulic oil flowing in an advance supply oil passage, which connects between the hydraulic oil supply source and the advance chamber.

The hydraulic oil controller includes a drain port, a partition, a recycle oil passage and a drain flow restrictor. The drain port is connected to an oil discharge portion that is configured to store the hydraulic oil discharged from the retard chamber or the advance chamber. The partition is configured to partition between a drain oil passage and a corresponding one of the retard supply oil passage and the advance supply oil passage. The drain oil passage connects between the oil discharge portion and a corresponding one of the retard chamber and the advance chamber. The recycle oil passage connects between: a portion of the drain oil passage located between the partition and the drain port; and the retard supply oil passage or the advance supply oil passage. With this configuration, the hydraulic oil can be reused by re-supplying a portion of the hydraulic oil, which is discharged from the advance chamber or the retard chamber and flows in the drain oil passage, to the retard chamber or the advance chamber through the recycle oil passage.

The drain flow restrictor is formed in the drain oil passage at a location between the partition and the drain port. A passage cross-sectional area of the drain flow restrictor is smaller than a smallest passage cross-sectional area of the recycle oil passage and is constant. With this configuration, it is possible to increase the amount of hydraulic oil, which is re-supplied to the retard chamber or the advance chamber through the recycle oil passage, while reducing the amount of the hydraulic oil discharged to the oil discharge portion through the drain flow restrictor. Therefore, the responsiveness of the valve timing adjustment device can be improved.

Hereinafter, a valve timing adjustment device of embodiments will be described with reference to the drawings. Components, which are substantially the same in the embodiments, are denoted by the same reference signs and will not be described redundantly. Moreover, the components, which are substantially the same in the embodiments, exert the same or similar effects.

First Embodiment

Figure 2:
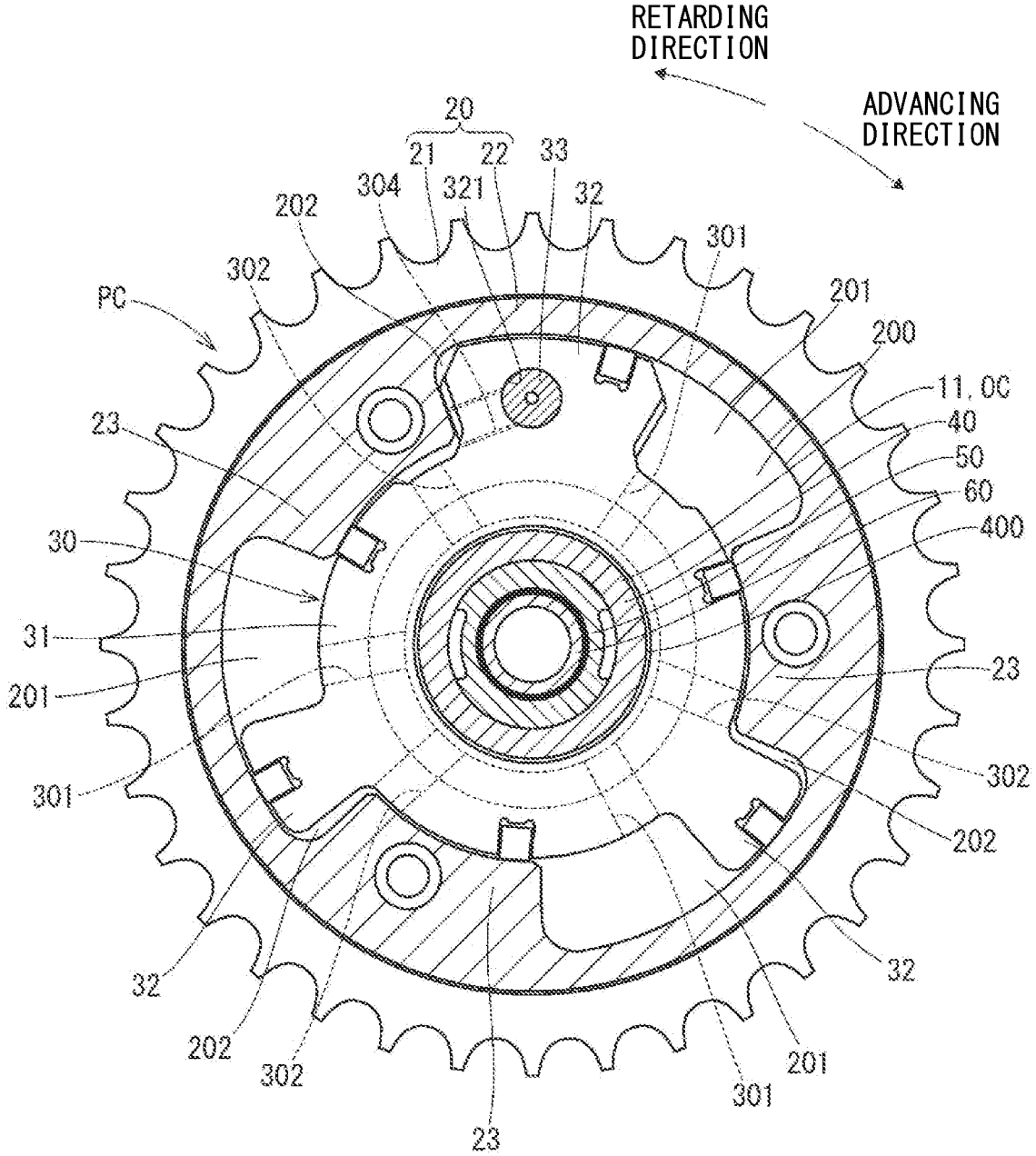
FIG. 2 is a cross-sectional view taken along line II-II in FIG. 1.

FIGS. 1 and 2 illustrate a valve timing adjustment device according to a first embodiment. The valve timing adjustment device 10 changes a rotational phase of a camshaft 3 relative to a crankshaft 2 of an engine 1 (serving as an internal combustion engine), so that the valve timing adjustment device 10 adjusts a valve timing of intake valves 4 among the intake valves 4 and exhaust valves 5 driven to open and close by the camshaft 3. The valve timing adjustment device 10 is installed in a drive force transmission path that extends from the crankshaft 2 to the camshaft 3. The crankshaft 2 corresponds to a drive shaft. The camshaft 3 corresponds to a driven shaft. The intake valves 4 and the exhaust valves 5 correspond to valves.

The structure of the valve timing adjustment device 10 will be described with reference to FIGS. 1 and 2. The valve timing adjustment device 10 includes a phase shifter PC and a hydraulic oil controller OC.

The phase shifter PC includes a housing 20 and a vane rotor 30. The housing 20 has a gear portion 21 and a case 22. The case 22 has a tubular portion 221 and plate portions 222, 223. The tubular portion 221 is shaped in a tubular form. The plate portion 222 is integrally formed with the tubular portion 221 in one-piece such that the plate portion 222 closes one end of the tubular portion 221. The plate portion 223 is formed to close the other end of the tubular portion 221. In this way, a space 200 is formed at an inside of the housing 20. The plate portion 223 is fixed to the tubular portion 221 by bolts 12. The gear portion 21 is formed at an outer periphery of the plate portion 223.

The plate portion 223 is fitted to an end portion of the camshaft 3. The camshaft 3 rotatably supports the housing 20. A chain 6 is wound around the gear portion 21 and the crankshaft 2. The gear portion 21 is rotated synchronously with the crankshaft 2. The case 22 forms a plurality of partition wall portions 23 that inwardly project from the tubular portion 221 in the radial direction. An opening 24 is formed at a center of the plate portion 222 of the case 22 such that the opening 24 opens to the space, which is located at the outside of the case 22. The opening 24 is located on an opposite side of the vane rotor 30, which is opposite to the camshaft 3.

The vane rotor 30 has a boss 31 and a plurality of vanes 32. The boss 31 is shaped in a tubular form and is fixed to the end portion of the camshaft 3. Each of the vanes 32 outwardly projects from the boss 31 in the radial direction and is placed between corresponding adjacent two of the partition wall portions 23. The space 200, which is formed at the inside of the housing 20, is divided into retard chambers 201 and advance chambers 202 by the vanes 32. That is, the housing 20 forms the retard chambers 201 and the advance chambers 202 between the housing 20 and the vane rotor 30. Each retard chamber 201 is positioned on one circumferential side of the corresponding vane 32. Each advance chamber 202 is positioned on the other circumferential side of the corresponding vane 32. The vane rotor 30 rotates relative to the housing 20 in a retarding direction or an advancing direction according to an oil pressure of the hydraulic oil (serve as the fluid) supplied to the respective retard chambers 201 and an oil pressure of the hydraulic oil (serve as the fluid) supplied to the respective advance chambers 202. Here, the retard chambers 201 and the advance chambers 202 correspond to hydraulic chambers (respectively serving as a fluid supply destination).

As described above, the phase shifter PC includes the retard chambers 201 and the advance chambers 202. The phase shifter PC is configured to adjust the valve timing of the intake valves 4 by shifting a rotational phase between the crankshaft 2 and the camshaft 3 with the hydraulic oil supplied from an oil pump 8 (serving as a hydraulic oil supply source OS) to the retard chambers 201 and the advance chambers 202.

A hydraulic oil control valve 11 (serving as a hydraulic oil controller OC) is configured to control a flow of the hydraulic oil supplied to the retard chambers 201 and the advance chambers 202 by controlling the hydraulic oil flowing in a retard supply oil passage RRs, which connects between the hydraulic oil supply source OS and the retard chambers 201, and the hydraulic oil flowing in an advance supply oil passage RAs, which connects between the hydraulic oil supply source OS and the advance chambers 202.

Figure 3:
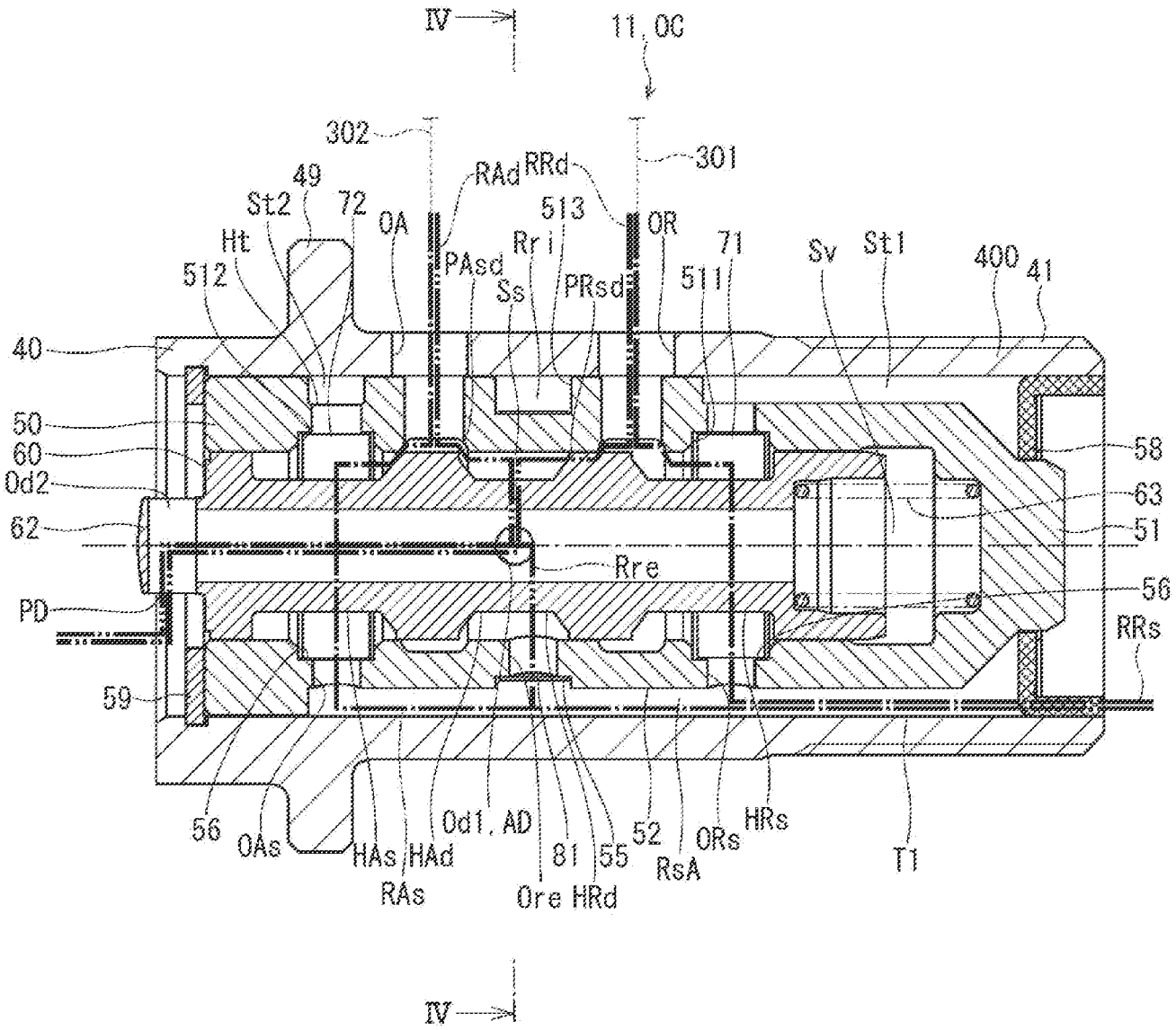
FIG. 3 is a cross-sectional view illustrating a hydraulic oil controller of the valve timing adjustment device according to the first embodiment.
Figure 4:
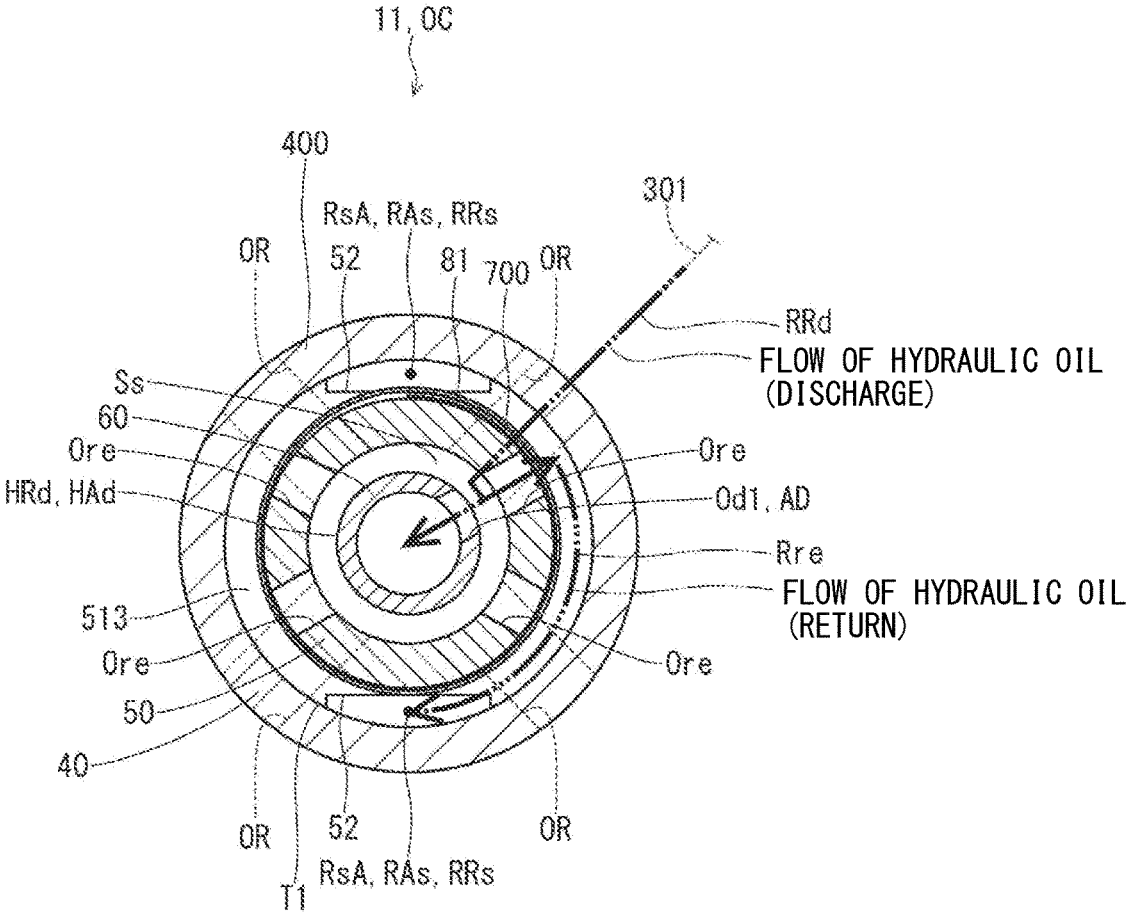
FIG. 4 is a cross-sectional view taken along line IV-IV in FIG. 3.

As shown in FIGS. 3 and 4, the hydraulic oil control valve 11 includes a sleeve 400, a spool 60, a plurality of valve seat surfaces 56, a plurality of drain ports PD, a partition PRsd, a partition PAsd, a recycle oil passage Rre, a drain flow restrictor AD, a retard supply check valve (serving as a check valve) 71, an advance supply check valve (serving as a check valve) 72, and a recycle check valve (serving as a check valve) 81.

The sleeve 400 includes an outer sleeve (serving as an outer tubular portion) 40 and an inner sleeve (serving as an inner tubular portion) 50. The outer sleeve 40 is shaped substantially in a cylindrical tubular form and is made of a material, which includes, for example, iron and has relatively high hardness. An inner peripheral wall of the outer sleeve 40 is shaped substantially in a cylindrical form. As illustrated in FIG. 3, a threaded portion 41 is formed at an outer peripheral wall of one end portion of the outer sleeve 40. A retaining portion 49 is formed at the other end portion of the outer sleeve 40 such that the retaining portion 49 is shaped in a ring form and outwardly extends from an outer peripheral wall of the other end portion of the outer sleeve 40 in the radial direction.

A shaft hole 100 and a plurality of supply holes 101 are formed at an end portion of the camshaft 3 located on the side where the valve timing adjustment device 10 is placed. The shaft hole 100 is formed to extend in an axial direction of the camshaft 3 from a center part of an end surface of the camshaft 3, which is located on the side where valve timing adjustment device 10 is placed. Each of the supply holes 101 is formed such that the supply hole 101 inwardly extend from an outer wall of the camshaft 3 in the radial direction and is communicated with the shaft hole 100 (see FIG. 1).

A shaft-side threaded portion 110 is formed at an inner wall of the shaft hole 100 of the camshaft 3 to threadably engage with the threaded portion 41 of the outer sleeve 40. The outer sleeve 40 passes through the inside of the boss 31 of the vane rotor 30 and is fixed to the camshaft 3 such that the threaded portion 41 of the outer sleeve 40 is engaged with the shaft-side threaded portion 110 of the camshaft 3. At this time, the retaining portion 49 retains an end surface of the boss 31 of the vane rotor 30, which is opposite to the camshaft 3. In this way, the vane rotor 30 is fixed to the camshaft 3 such that the vane rotor 30 is held between the camshaft 3 and the retaining portion 49. The outer sleeve 40 is thus installed to the center part of the vane rotor 30.

The oil pump 8 (serving as the hydraulic oil supply source OS) suctions the hydraulic oil stored in an oil pan 7 (serving as an oil discharge portion OD) and supplies the suctioned hydraulic oil to the supply holes 101. As a result, the hydraulic oil flows into the shaft hole 100.

The inner sleeve 50 is shaped substantially in a cylindrical tubular form and is made of a material, which includes, for example, aluminum and has relatively low hardness. Specifically, the inner sleeve 50 is made of the material that has the hardness lower than that of the outer sleeve 40. An inner peripheral wall and an outer peripheral wall of the inner sleeve 50 are respectively shaped substantially in a cylindrical form. The inner sleeve 50 is subjected to surface hardening using anodized aluminum or the like, so that a surface layer of the inner sleeve 50 has hardness that is higher than hardness of a base material of the inner sleeve 50.

As illustrated in FIG. 3, the inner sleeve 50 is placed at the inside of the outer sleeve 40 such that an outer peripheral wall of the inner sleeve 50 is fitted to an inner peripheral wall of the outer sleeve 40. The inner sleeve 50 is immovable relative to the outer sleeve 40. A sleeve sealing portion 51 is formed at one end of the inner sleeve 50. The sleeve sealing portion 51 closes the one end of the inner sleeve 50. Here, the inner sleeve 50 corresponds to a sleeve.

The spool 60 is shaped substantially in a cylindrical tubular form and is made of, for example, metal. Here, the spool 60 corresponds to a tubular member. The spool 60 is placed in an inside of the inner sleeve 50 such that an outer peripheral wall of the spool 60 is slidable along the inner peripheral wall of the inner sleeve 50 to enable reciprocation of the spool 60 in the axial direction. Specifically, the spool 60 is placed at the inside of the inner sleeve 50 such that the spool 60 is movable in the axial direction relative to the inner sleeve 50. A spool sealing portion 62 is formed at one end of the spool 60. The spool sealing portion 62 closes the one end of the spool 60.

A variable volume space Sv is formed between the sleeve sealing portion 51 and the other end of the spool 60 at the inside of the inner sleeve 50. A volume of the variable volume space Sv changes when the spool 60 is moved in the axial direction relative to the inner sleeve 50. Specifically, the sleeve sealing portion 51 forms the variable volume space Sv, the volume of which changes, between the sleeve sealing portion 51 and the spool 60.

A spring 63 is installed in the variable volume space Sv. The spring 63 is a so-called coil spring. One end of the spring 63 contacts the sleeve sealing portion 51, and other end of the spring 63 contacts the other end of the spool 60.

The spring 63 urges the spool 60 in a direction away from the sleeve sealing portion 51.

A retaining portion 59 is placed on the radially inner side of the other end portion of the outer sleeve 40. The retaining portion 59 is shaped in a plate form. An outer periphery of the retaining portion 59 is fitted to the inner peripheral wall of the outer sleeve 40. A hole is formed at a center of the retaining portion 59, and the spool sealing portion 62 is installed in an inside of this hole.

An inner periphery of the retaining portion 59 is configured to retain the one end of the spool 60. The retaining portion 59 can limit movement of the spool 60 toward a side that is opposite to the sleeve sealing portion 51. In this way, removal of the spool 60 from the inside of the inner sleeve 50 is limited.

The spool 60 is movable in the axial direction from a position, at which the spool 60 contacts the retaining portion 59, to a position, at which the spool 60 contacts the sleeve sealing portion 51. Specifically, a movable range of the spool 60 relative to the sleeve 400 extends from the position, at which the spool 60 contacts the retaining portion 59 (see FIG. 3), to the position, at which the spool 60 contacts the sleeve sealing portion 51. Hereinafter, this movable range of the spool 60 will be referred to as a stroke range.

As illustrated in FIG. 3, the end portion of the inner sleeve 50, which is located on the sleeve sealing portion 51 side, has an outer diameter that is smaller than an inner diameter of the outer sleeve 40. Thus, a cylindrical space St1, which is shaped substantially in a cylindrical form, is formed between an outer peripheral wall of the end portion of the inner sleeve 50, which is located on the sleeve sealing portion 51 side, and the inner peripheral wall of the outer sleeve 40.

Moreover, an annular recess Ht is formed at the inner sleeve 50. The annular recess Ht, which is shaped in an annular form, is radially inwardly recessed at a portion of the outer peripheral wall of the inner sleeve 50, which corresponds to the retaining portion 49. In this way, an annular space St2, which is shaped in an annular form, is formed between the annular recess Ht and the inner peripheral wall of the outer sleeve 40.

Passage grooves 52 are formed at the inner sleeve 50. Each of the passage grooves 52 is radially inwardly recessed at the outer peripheral wall of the inner sleeve 50 and extends in the axial direction of the inner sleeve 50 (see FIG. 3). The number of the passage grooves 52 is two, and these passage grooves 52 are arranged one after another at equal intervals along the inner sleeve 50 in the circumferential direction (see FIG. 4). Each of the passage grooves 52 forms an axial supply oil passage (serving as an axial flow passage) RsA. Specifically, each axial supply oil passage RsA is formed to extend in the axial direction of the sleeve 400 at an interface T1 between the outer sleeve 40 and the inner sleeve 50. One end of each axial supply oil passage RsA is connected to the cylindrical space St1, and the other end of the axial supply oil passage RsA is connected to the annular space St2.

As shown in FIG. 3, limiting grooves 511, 512 are formed at the inner sleeve 50. The limiting groove 511, which is shaped in an annular form, is radially outwardly recessed at a portion of the inner peripheral wall of the inner sleeve 50, which corresponds to an end portion of the cylindrical space St1. The limiting groove 512, which is shaped in an annular form, is radially outwardly recessed at a portion of the inner peripheral wall of the inner sleeve 50, which corresponds to the annular recess Ht.

The valve seat surfaces 56 are shaped generally in a cylindrical form and are respectively formed at bottom surfaces of the limiting grooves 511, 512 at the inner peripheral wall of the inner sleeve (serving as the sleeve) 50.

Furthermore, a movement limiting portion 513 is formed at the inner sleeve 50. The movement limiting portion 513 is an annular recess that is radially inwardly recessed at a portion of the outer peripheral wall of the inner sleeve 50, which is located between the limiting groove 511 and the limiting groove 512. As a result, circumferential parts of the movement limiting portion 513 are respectively connected to the passage grooves 52.

The movement limiting portion 513 forms an annular flow passage Rri. Specifically, the annular flow passage Rri is formed in an annular form such that the annular flow passage Rri extends in the circumferential direction of the sleeve 400 while the annular flow passage Rri is connected to each of the axial supply passages RsA at a location between the outer sleeve 40 and the inner sleeve 50.

The sleeve 400 has a plurality of retard supply openings ORs, a plurality of advance supply openings OAs, a plurality of retard openings OR, a plurality of advance openings OA, and a plurality of recycle openings Ore.

Each of the retard supply openings ORs extends at the sleeve 400 in the radial direction and is configured to connect the corresponding valve seat surface 56 of the inner sleeve 50 to the annular space St1 and the axial supply passage RsA (see FIG. 3). Specifically, each of the retard supply openings ORs communicates between the outside of the inner sleeve (serving as the sleeve) 50 and the corresponding valve seat surface 56. Each of the retard supply openings ORs opens at the corresponding valve seat surface 56. The retard supply openings ORs are arranged one after another along the inner sleeve 50 in the circumferential direction.

Each of the advance supply openings OAs extends at the sleeve 400 in the radial direction and is configured to connect the corresponding valve seat surface 56 of the inner sleeve 50 to the annular space St2 and the axial supply passage RsA (see FIG. 3). Specifically, each of the advance supply openings OAs communicates between the outside of the inner sleeve (serving as the sleeve) 50 and the corresponding valve seat surface 56. Each of the advance supply openings OAs opens at the corresponding valve seat surface 56. The advance supply openings OAs are arranged one after another along the inner sleeve 50 in the circumferential direction.

Each of the retard openings OR extends at the sleeve 400 in the radial direction and is configured to connect the space, which is located at the inside of the inner sleeve 50, to the space, which is located at the outside of the outer sleeve 40. The retard openings OR are arranged one after another along the sleeve 400 in the circumferential direction. Each of the retard openings OR is communicated with the corresponding retard chamber 201 through a corresponding retard oil passage 301.

Each of the advance openings OA extends at the sleeve 400 in the radial direction and is configured to connect the space, which is located at the inside of the inner sleeve 50, to the space, which is located at the outside of the outer sleeve 40. The advance openings OA are located on the retaining portion 49 side of the retard openings OR. The advance openings OA are arranged one after another along the sleeve 400 in the circumferential direction. Each of the advance openings OA is communicated with the corresponding advance chamber 202 through a corresponding advance oil passage 302.

A valve seat surface 55, which is shaped generally in a cylindrical form, is formed at the movement limiting portion 513 of the inner sleeve 50 (see FIG. 3). Specifically, the valve seat surface 55 is formed in the cylindrical form on the side of the annular flow passage Rri where the inner sleeve 50 is placed. Each of the recycle openings Ore extends at the sleeve 400 in the radial direction and communicates between the valve seat surface 55 and the inside of the inner sleeve 50. Specifically, each of the recycle openings Ore connects between the annular flow passage Rri and the inside space of the inner sleeve 50. The recycle openings Ore are arranged one after another along the inner sleeve 50 in the circumferential direction. In the present embodiment, the number of the recycle openings Ore is four (see FIG. 4).

The spool 60 has a retard supply recess HRs, a retard drain recess HRd, an advance drain recess HAd, and an advance supply recess HAs. The retard supply recess HRs, the retard drain recess HRd, the advance drain recess HAd and the advance supply recess HAs are respectively shaped in an annular form and radially inwardly recessed from the outer peripheral wall of the spool 60. The retard supply recess HRs, the retard drain recess HRd, the advance drain recess HAd and the advance supply recess HAs are arranged one after another in this order in the axial direction of the spool 60. The retard drain recess HRd and the advance drain recess HAd are formed integrally. The retard drain recess HRd and the advance drain recess HAd form a specific space Ss relative to the inner peripheral wall of the inner sleeve 50. Specifically, the spool 60 forms the specific space Ss between the spool 60 and the sleeve 400.

The retard supply oil passage RRs connects the oil pump 8 to the retard chambers 201 through the hydraulic oil control valve 11. The advance supply oil passage RAs connects the oil pump 8 to the advance chambers 202 through the hydraulic oil control valve 11.

The retard drain oil passage RRd, which serves as the drain oil passage, connects the retard chambers 201 to the oil pan 7. The advance drain oil passage RAd, which serves as the drain passage, connects the advance chambers 202 to the oil pan 7.

The retard supply oil passage RRs connects the oil pump 8 to the retard chambers 201 through the supply holes 101, the shaft hole 100, the cylindrical space St1, the axial supply oil passages RsA, the retard supply openings ORs, the limiting groove 511, the retard supply recess HRs, the retard openings OR and the retard oil passages 301. Specifically, the hydraulic oil, which is conducted between the oil pump 8 and the retard chambers 201, can flow through the retard supply openings (serving as a flow passage) ORs.

The advance supply oil passage RAs connects the oil pump 8 to the advance chambers 202 through the supply holes 101, the shaft hole 100, the cylindrical space St1, the axial supply oil passages RsA, the advance supply openings OAs, the limiting groove 512, the advance supply recess HAs, the advance openings OA, and the advance oil passages 302. Specifically, the hydraulic oil, which is conducted between the oil pump 8 and the advance chambers 202, can flow through the advance supply openings (serving as a flow passage) OAs.

A plurality of drain opening Od2 is formed at the spool 60. Each of the drain openings Od2 extends through the spool sealing portion 62 in the radial direction and communicates between the inside space of the spool 60 and the outside of the spool 60 (see FIG. 3).

In the present embodiment, the drain ports PD correspond to the drain openings Od2. Specifically, each of the drain ports PD extends through the spool sealing portion 62 in the radial direction and communicates between the inside space of the spool 60 and the outside of the spool 60 (see FIG. 3). Drain ports PD are connected to the oil pan 7 (serving as the oil discharge portion OD) that is configured to store the hydraulic oil discharged from the retard chambers 201 or the advance chambers 202.

The partition PRsd is formed at an end portion of the retard drain recess HRd of the spool 60, which is opposite to the advance drain recess HAd. The partition PRsd partitions between the retard drain oil passage RRd and the retard supply oil passage RRs (see FIG. 3).

The partition PAsd is formed at an end portion of the advance drain recess HAd of the spool 60, which is opposite to the retard drain recess HRd. The partition PAsd partitions between the advance drain oil passage RAd and the advance supply oil passage RAs (see FIG. 3).

The recycle oil passage Rre connects between: a portion of each of the retard drain oil passage (serving as the drain oil passage) RRd and the advance drain oil passage (serving as the drain oil passage) RAd located between the drain ports PD and the corresponding one of the partition PRsd and the partition PAsd; and the retard supply oil passage RRs or the advance supply oil passage RAs.

As shown in FIG. 3, the recycle oil passage Rre extends from the specific space Ss to the retard supply oil passage RRs and the advance supply oil passage RAs, i.e., the axial supply oil passages RsA through the recycle openings Ore, the movement limiting portion 513 and the annular flow passage Rri.

A drain opening Od1 is formed at the spool 60. The drain opening Od1 communicates the inside space of the spool 60 to the retard drain recess HRd and the advance drain recess HAd, i.e., the specific space Ss.

In the present embodiment, the drain flow restrictor AD corresponds to, i.e., is the drain opening Od1. Specifically, the drain flow restrictor AD is formed at the spool 60. The drain flow restrictor AD communicates the inside space of the spool 60 to the retard drain recess HRd and the advance drain recess HAd, i.e., the specific space Ss. The drain flow restrictor AD extends through a wall of the spool 60 in the radial direction, and the number of the drain flow restrictor AD is one all around the spool 60 in the circumferential direction.

As described above, the drain flow restrictor AD is formed in the retard drain oil passage (serving as the drain oil passage) RRd and the advance drain oil passage (serving as the drain oil passage) RAd at the location between: the partition PRsd or the partition PAsd; and the drain ports PD.

A passage cross-sectional area of the drain flow restrictor AD is smaller than a smallest passage cross-sectional area of the recycle oil passage Rre and is constant regardless of a relative position of the spool 60 relative to the sleeve 400. Here, the passage cross-sectional area of the drain flow restrictor AD corresponds to a cross-sectional area of the drain flow restrictor AD, i.e., the drain opening Od1, which is perpendicular to an axis of the drain opening Od1. Furthermore, the smallest passage cross-sectional area of the recycle oil passage Rre corresponds to a sum of cross-sectional areas of the four recycle openings Ore of the recycle oil passage Rre, each of which is perpendicular to an axis of the recycle opening Ore (see FIG. 4). A sum of the passage cross-sectional areas of the drain ports PD, i.e., the drain openings Od2 is larger than the passage cross-sectional area of the drain flow restrictor AD, i.e., the drain opening Od1. Furthermore, in a case where the passage cross-sectional area of the drain flow restrictor AD is indicated by Sr1, and the smallest passage cross-sectional area of the recycle oil passage Rre is indicated by Sr2, there is a relationship of, for example, Sr1/Sr2<¼ in the present embodiment.

In the present embodiment, the drain flow restrictor AD has a passage cross-section that is shaped in a form of a circle.

In the present embodiment, an orifice diameter of the drain flow restrictor AD is set to be in a range of 1.5 mm to 2.5 mm. Specifically, the passage cross-sectional area of the drain flow restrictor AD is set to be in a range of 1.77 $mm^2$ to 4.91 $mm^2$.

The retard drain oil passage RRd connects the retard chambers 201 to the oil pan 7 through the retard oil passages 301, the retard openings OR, the retard drain recess HRd, the drain flow restrictor AD and the drain ports PD.

The advance drain oil passage RAd connects the advance chambers 202 to the oil pan 7 through the advance oil passages 302, the advance openings OA, the advance drain recess HAd, the drain flow restrictor AD and the drain ports PD.

Thus, a part of each of the retard supply oil passage RRs, the advance supply oil passage RAs, the retard drain oil passage RRd and the advance drain oil passage RAd is formed at the inside of the hydraulic oil control valve 11. Each axial supply oil passage RsA extends in the axial direction of the sleeve 400 in the advance supply oil passage RAs. Specifically, the sleeve 400 has the axial supply oil passages RsA, each of which extends in the axial direction of the sleeve 400 in the advance supply oil passage RAs.

The drain flow restrictor AD is connected to the specific space Ss in the drain oil passage and extends from the specific space Ss in the radial direction of the sleeve 400 or the spool 60. Each recycle opening Ore is connected to the specific space Ss in the recycle oil passage Rre and extends from the specific space Ss toward the side that is opposite to the drain flow restrictor AD. The recycle oil passage Rre is connected to the retard drain oil passage RRd and the advance drain oil passage RAd at the specific space Ss (see FIGS. 3 and 4).

When the spool 60 is in contact with the retaining portion 59 (see FIG. 3), i.e., when the spool 60 is positioned at one end of the stroke range, the spool 60 opens the retard openings OR. Thereby, the oil pump 8 is communicated with the retard chambers 201 through the supply holes 101, the shaft hole 100, the cylindrical space St1, the axial supply oil passages RsA, the retard supply openings ORs, the limiting groove 511, the retard supply recess HRs, the retard openings OR and the retard oil passages 301 in the retard supply oil passage RRs. As a result, the hydraulic oil can be supplied from the oil pump 8 to the retard chambers 201 through the retard supply oil passage RRs. Moreover, at this time, the advance chambers 202 are communicated with the oil pan 7 through the advance oil passages 302, the advance openings OA, the advance drain recess HAd, the drain flow restrictor AD and the drain ports PD in the advance drain oil passage RAd. As a result, the hydraulic oil can be discharged from the advance chambers 202 to the oil pan 7 through the advance drain oil passage RAd.

When the spool 60 is positioned between the retaining portion 59 and the sleeve sealing portion 51, i.e., when the spool 60 is positioned in the middle of the stroke range, the oil pump 8 is communicated with the advance chambers 202 through the supply holes 101, the shaft hole 100, the cylindrical space St1, the axial supply oil passages RsA, the advance supply openings OAs, the limiting groove 512, the advance supply recess HAs, the advance openings OA and the advance oil passages 302 in the advance supply oil passage RAs. At this time, the oil pump 8 is communicated to the retard chambers 201 through the retard supply oil passage RRs. As a result, the hydraulic oil can be supplied from the oil pump 8 to the retard chambers 201 and the advance chambers 202 through the retard supply oil passage RRs and the advance supply oil passage RAs. However, the retard drain oil passage RRd and the advance drain oil passage RAd are closed, i.e., is blocked by the partition PRsd and the partition PAsd of the spool 60. Therefore, the hydraulic oil is not discharged from the retard chambers 201 and the advance chambers 202 to the oil pan 7.

When the spool 60 is in contact with the sleeve sealing portion 51, i.e., when the spool 60 is positioned at the other end of the stroke range, the retard chambers 201 are communicated with the oil pan 7 through the retard oil passages 301, the retard openings OR, the retard drain recess HRd, the drain flow restrictor AD and the drain port PD in the retard drain oil passage RRd. At this time, the oil pump 8 is communicated with the advance chambers 202 through the advance supply oil passage RAs. As a result, the hydraulic oil can be discharged from the retard chambers 201 to the oil pan 7 through the retard drain oil passage RRd, and the hydraulic oil can be supplied from the oil pump 8 to the advance chambers 202 through the advance supply oil passage RAs.

A filter 58 is installed at an inside of the end portion of the outer sleeve 40 located on the side where the sleeve sealing portion 51 is placed, i.e., the filter 58 is installed at the middle of the retard supply oil passage RRs and the advance supply oil passage RAs. The filter 58 is, for example, a mesh that is shaped in a circular ring form. The filter 58 can capture foreign objects contained in the hydraulic oil. Therefore, it is possible to limit flow of the foreign objects toward the downstream side of the filter 58, i.e., toward the side that is opposite to the oil pump 8.

The advance supply check valve 72 is formed by rolling a rectangular metal thin plate (serving as a single plate material) into a cylindrical tubular form such that an outer peripheral wall of the advance supply check valve 72 can contact the valve seat surface 56. The advance supply check valve 72 is installed to the limiting groove 512 such that the outer peripheral wall of the advance supply check valve 72 can contact the valve seat surface 56. The advance supply check valve 72 is installed such that the advance supply check valve 72 is resiliently deformable in the radial direction in the limiting groove 512. The advance supply check valve 72 is located on the radially inner side of the advance supply openings OAs in the radial direction of the inner sleeve 50. The advance supply check valve 72 is installed in the limiting groove 512 as follows. That is, in a state where the hydraulic oil does not flow in the advance supply oil passage RAs, i.e., in a state where an external force is not applied to the advance supply check valve 72, one end portion of the advance supply check valve 72 overlaps with the other end portion of the advance supply check valve 72 in the circumferential direction.

When the hydraulic oil flows from the advance supply openings OAs toward the advance supply recess HAs in the advance supply oil passage RAs, the advance supply check valve 72 is deformed such that the outer peripheral wall of the advance supply check valve 72 is radially inwardly urged by the hydraulic oil and shrinks radially inward, i.e., a diameter of the advance supply check valve 72 is reduced. Therefore, the outer peripheral wall of the advance supply check valve 72 is spaced away from the valve seat surface 56 to place the advance supply check valve 72 in the valve opening state, so that the hydraulic oil can flow toward the advance supply recess HAs through the advance supply openings OAs and the advance supply check valve 72. At this time, the advance supply check valve 72 maintains the state where the one end portion of the advance supply check valve 72 overlaps with the other end portion side of the advance supply check valve 72 while increasing a length of the overlapping range of the advance supply check valve 72.

When the flow rate of the hydraulic oil, which flows through the advance supply oil passage RAs, becomes lower than or equal to a predetermined value, the advance supply check valve 72 is deformed to expand radially outward, i.e., the diameter of the advance supply check valve 72 is increased. When the hydraulic oil flows from the advance supply recess HAs toward the advance supply openings OAs, the inner peripheral wall of the advance supply check valve 72 is radially outwardly urged by the hydraulic oil. Thus, the outer peripheral wall of the advance supply check valve 72 contacts the valve seat surface 56 and is thereby placed in the valve closing state. In this way, the flow of the hydraulic oil from the advance supply recess HAs toward the advance supply openings OAs is limited.

As discussed above, the advance supply check valve 72 functions as the check valve in such a way that the advance supply check valve 72 enables the flow of the hydraulic oil from the advance supply openings OAs to the advance supply recess HAs and limits the flow of the hydraulic oil from the advance supply recess HAs to the advance supply openings OAs. Specifically, the advance supply check valve 72 is located on the oil pump 8 side of the spool 60 of the hydraulic oil control valve 11 in the advance supply oil passage RAs, and the advance supply check valve 72 enables only the flow of the hydraulic oil from the oil pump 8 side toward the advance chambers 202.

A configuration of the retard supply check valve 71 is similar to that of the advance supply check valve 72 and is formed by rolling a rectangular metal thin plate (serving as a single plate material) into a cylindrical tubular form. The retard supply check valve 71 is installed to the limiting groove 511 such that the outer peripheral wall of the retard supply check valve 71 can contact the valve seat surface 56. The retard supply check valve 71 is installed such that the retard supply check valve 71 is resiliently deformable in the radial direction in the limiting groove 511. The retard supply check valve 71 is located on the radially inner side of the retard supply openings ORs in the radial direction of the inner sleeve 50. The retard supply check valve 71 is installed in the limiting groove 511 as follows. That is, in a state where the hydraulic oil does not flow in the retard supply oil passage RRs, i.e., in a state where an external force is not applied to the retard supply check valve 71, one end portion of the retard supply check valve 71 overlaps with the other end portion of the retard supply check valve 71 in the circumferential direction.

When the hydraulic oil flows from the retard supply openings ORs toward the retard supply recess HRs in the retard supply oil passage RRs, the retard supply check valve 71 is deformed such that the outer peripheral wall of the retard supply check valve 71 is radially inwardly urged by the hydraulic oil and shrinks radially inward, i.e., a diameter of the retard supply check valve 71 is reduced. Therefore, the outer peripheral wall of the retard supply check valve 71 is spaced away from the valve seat surface 56 to place the retard supply check valve 71 in the valve opening state, so that the hydraulic oil can flow toward the retard supply recess HRs through the retard supply openings ORs and the retard supply check valve 71. At this time, the retard supply check valve 71 maintains the state where the one end portion of the retard supply check valve 71 overlaps with the other end portion side of the retard supply check valve 71 while increasing a length of the overlapping range of the retard supply check valve 71.

When the flow rate of the hydraulic oil, which flows through the retard supply oil passage RRs, becomes lower than or equal to a predetermined value, the retard supply check valve 71 is deformed to expand radially outward, i.e., the diameter of the retard supply check valve 71 is increased. When the hydraulic oil flows from the retard supply recess HRs toward the retard supply openings ORs, the inner peripheral wall of the retard supply check valve 71 is radially outwardly urged by the hydraulic oil. Thereby, the outer peripheral wall of the retard supply check valve 71 contacts the valve seat surface 56 and is thereby placed in the valve closing state. In this way, the flow of the hydraulic oil from the retard supply recess HRs toward the retard supply openings ORs is limited.

As discussed above, the retard supply check valve 71 functions as a check valve in such a way that the retard supply check valve 71 enables the flow of the hydraulic oil from the retard supply openings ORs toward the retard supply recess HRs and limits the flow of the hydraulic oil from the retard supply recess HRs toward the retard supply openings ORs. Specifically, the retard supply check valve 71 is located on the oil pump 8 side of the spool 60 of the hydraulic oil control valve 11 in the retard supply oil passage RRs, and the retard supply check valve 71 enables only the flow of the hydraulic oil from the oil pump 8 side toward the retard chambers 201.

The configuration of the recycle check valve 81 is similar to that of the advance supply check valve 72 except a difference in the outer diameter thereof and is formed by rolling a rectangular metal thin plate (serving as a single plate material) into a cylindrical tubular form. The recycle check valve 81 is installed in the movement limiting portion 513, i.e., is installed at the annular flow passage Rri in the recycle oil passages Rre. The recycle check valve 81 is installed such that the recycle check valve 81 is resiliently deformable in the radial direction at the annular flow passage Rri. The recycle check valve 81 is located on the radially outer side of the valve seat surface 55 in the radial direction of the inner sleeve 50. The recycle check valve 81 is installed in the annular flow passage Rri such that in the state where the hydraulic oil does not flow in the recycle oil passage Rre, i.e., in the state where the external force is not applied to the recycle check valve 81, one end portion of the recycle check valve 81 overlaps with the other end portion of the recycle check valve 81.

When the hydraulic oil flows from the recycle openings Ore to the annular flow passage Rri in the recycle oil passage Rre, the recycle check valve 81 is deformed such that the inner peripheral wall of the recycle check valve 81 is radially outwardly urged by the hydraulic oil and expands radially outward, i.e., the diameter of the recycle check valve 81 is increased. Therefore, the inner peripheral wall of the recycle check valve 81 is spaced away from the valve seat surface 55 to place the recycle check valve 81 in the valve opening state, so that the hydraulic oil can flow toward the annular flow passage Rri through the recycle check valve 81.

When the flow rate of the hydraulic oil, which flows in the recycle oil passage Rre, becomes lower than or equal to a predetermined value, the recycle check valve 81 is deformed to shrink radially inward, i.e., a diameter of the recycle check valve 81 is reduced. When the hydraulic oil flows from the annular flow passage Rri toward the recycle openings Ore, the outer peripheral wall of the recycle check valve 81 is radially inwardly urged by the hydraulic oil so that the recycle check valve 81 contacts the valve seat surface 55 to place the recycle check valve 81 in the valve closing state. Thereby, the flow of the hydraulic oil from the annular flow passage Rri toward the recycle openings Ore is limited.

As discussed above, the recycle check valve 81 functions as a check valve in such a way that the recycle check valve 81 enables the flow of the hydraulic oil from the recycle openings Ore to the annular flow passage Rri and limits the flow of the hydraulic oil from the annular flow passage Rri to the recycle openings Ore. That is, the recycle check valve 81 enables only the flow of the hydraulic oil from the drain oil passage to the retard supply oil passage RRs and the advance supply oil passage RAs in the recycle oil passage Rre. The movement limiting portion 513 can limit axial movement of the recycle check valve 81.

As shown in FIG. 1, a linear solenoid 9 is located on a side of the spool 60, which is opposite to the camshaft 3. The linear solenoid 9 is configured to contact the spool sealing portion 62. When the linear solenoid 9 is energized, the linear solenoid 9 urges the spool 60 toward the camshaft 3 through the spool sealing portion 62 against the urging force of the spring 63. As a result, the position of the spool 60 in the axial direction relative to the sleeve 400 changes in the stroke range.

The variable volume space Sv is communicated with the retard drain oil passage RRd and the advance drain oil passage RAd. The variable volume space Sv is thus opened to the atmosphere through the drain openings Od2 of the retard drain oil passage RRd and the advance drain oil passage RAd. As a result, the pressure in the variable volume space Sv can be made equal to the atmospheric pressure. This allows for smooth movement of the spool 60 in the axial direction.

Next, a change in the flow of the hydraulic oil induced by a change in the position of the spool 60 relative to the sleeve 400 will be described.

When the spool 60 is in contact with the retaining portion 59, i.e., when the spool 60 is positioned at the one end of the stroke range, the hydraulic oil is supplied from the oil pump 8 to the retard chambers 201 through the retard supply oil passage RRs. At this time, the hydraulic oil is discharged from the advance chambers 202 to the oil pan 7 through the advance drain oil passage RAd. Moreover, a portion of the hydraulic oil, which flows in the advance drain oil passage RAd, is returned to the axial supply oil passage RsA side and the retard supply oil passage RRs side through the recycle oil passage Rre. As a result, the hydraulic oil, which is discharged from the advance chambers 202, can be reused. At this time, the recycle check valve 81 limits backflow of the hydraulic oil from the axial supply oil passage RsA to the drain oil passage in the recycle oil passage Rre.

When the spool 60 is positioned between the retaining portion 59 and the sleeve sealing portion 51, i.e., when the spool 60 is positioned in the middle of the stroke range, the hydraulic oil is supplied from the oil pump 8 to the retard chambers 201 through the retard supply oil passage RRs. At this time, the hydraulic oil is supplied from the oil pump 8 to the advance chambers 202 through the advance supply oil passage RAs. Also, at this time, the retard drain oil passage RRd and the advance drain oil passage RAd are closed by the spool 60, so that the hydraulic oil does not flow to the drain oil passage and is not returned to the axial supply oil passage RsA through the recycle oil passage Rre.

When the spool 60 is in contact with the sleeve sealing portion 51, i.e., when the spool 60 is positioned at the other end of the stroke range, the hydraulic oil is supplied from the oil pump 8 to the advance chambers 202 through the advance supply oil passage RAs. At this time, the hydraulic oil is discharged from the retard chambers 201 to the oil pan 7 through the retard drain oil passage RRd. Moreover, a portion of the hydraulic oil, which flows in the retard drain oil passage RRd, is returned to the axial supply oil passage RsA and the advance supply oil passage RAs through the recycle oil passage Rre. As a result, the hydraulic oil, which is discharged from the retard chambers 201, can be reused. At this time, the recycle check valve 81 limits backflow of the hydraulic oil from the axial supply oil passage RsA to the drain oil passage in the recycle oil passage Rre.

In the present embodiment, a lock pin 33 is further provided (see FIGS. 1 and 2). The lock pin 33 is shaped in a bottomed cylindrical tubular form. The lock pin 33 is received in a receiving hole 321 formed at the vane 32 in such a manner that the lock pin 33 can axially reciprocate in the receiving hole 321. A spring 34 is installed in an inside of the lock pin 33. The spring 34 urges the lock pin 33 toward the plate portion 222 of the case 22. A fitting recess 25 is formed at the plate portion 222 of the case 22 on the vane 32 side of the plate portion 222.

The lock pin 33 can be fitted into the fitting recess 25 when the vane rotor 30 is held at a most retarded position with respect to the housing 20. When the lock pin 33 is fitted into the fitting recess 25, relative rotation of the vane rotor 30 relative to the housing 20 is limited. On the other hand, when the lock pin 33 is not fitted into the fitting recess 25, the relative rotation of the vane rotor 30 relative to the housing 20 is enabled.

A pin control oil passage 304, which is communicated with a corresponding one of the advance chambers 202, is formed in the vane 32 at a location between the lock pin 33 and the advance chamber 202 (see FIG. 2). The pressure of the hydraulic oil, which flows from the advance chamber 202 into the pin control oil passage 304, is exerted in a removing direction for removing the lock pin 33 from the fitting recess 25 against the urging force of the spring 34.

In the valve timing adjustment device 10 constructed in the above-described manner, when the hydraulic oil is supplied to the advance chambers 202, the hydraulic oil flows into the pin control oil passage 304. Thereby, the lock pin 33 is removed from the fitting recess 25, and thereby the relative rotation of the vane rotor 30 relative to the housing 20 is enabled.

Next, the operation of the valve timing adjustment device 10 will be described. The valve timing adjustment device 10 drives the hydraulic oil control valve 11 among a first operating state, a second operating state and a phase holding state when the linear solenoid 9 is driven to urge the spool 60 of the hydraulic oil control valve 11. In the first operating state of the hydraulic oil control valve 11, the oil pump 8 is connected to the retard chambers 201, and the advance chambers 202 are connected to the oil pan 7. In the second operating state of the hydraulic oil control valve 11, the oil pump 8 is connected to the advance chambers 202, and the retard chambers 201 are connected to the oil pan 7. In the phase holding state of the hydraulic oil control valve 11, the oil pump 8 is connected to the retard chambers 201 and the advance chambers 202, and the connection of the retard chambers 201 to the oil pan 7 and the connection of the advance chambers 202 to the oil pan 7 are blocked to maintain the current phase of the phase shifter PC.

In the first operating state, the hydraulic oil is supplied to the retard chambers 201 through the retard supply oil passage RRs, and the hydraulic oil is returned from the advance chambers 202 to the oil pan 7 through the advance drain oil passage RAd. In addition, the hydraulic oil is returned from the advance drain oil passage RAd to the retard supply oil passage RRs through the recycle oil passage Rre.

In the second operating state, the hydraulic oil is supplied to the advance chambers 202 through the advance supply oil passage RAs, and the hydraulic oil is returned from the retard chambers 201 to the oil pan 7 through the retard drain oil passage RRd. In addition, the hydraulic oil is returned from the retard drain oil passage RRd to the advance supply oil passage RAs through the recycle oil passage Rre.

In the phase holding state, the hydraulic oil is supplied to the retard chambers 201 and the advance chambers 202 through the retard supply oil passage RRs and the advance supply oil passage RAs, and the discharge of the hydraulic oil from the retard chambers 201 and the advance chambers 202 is limited.

The valve timing adjustment device 10 brings the hydraulic oil control valve 11 into the first operating state when the rotational phase of the camshaft 3 is on the advance side of a target value. As a result, the vane rotor 30 undergoes relative rotation in the retarding direction relative to the housing 20, so that the rotational phase of the camshaft 3 shifts to the retard side.

The valve timing adjustment device 10 brings the hydraulic oil control valve 11 into the second operating state when the rotational phase of the camshaft 3 is on the retard side of the target value. As a result, the vane rotor 30 undergoes relative rotation in the advancing direction relative to the housing 20, so that the rotational phase of the camshaft 3 shifts to the advance side.

The valve timing adjustment device 10 brings the hydraulic oil control valve 11 into the phase holding state when the rotational phase of the camshaft 3 coincides with the target value. In this way, the rotational phase of the camshaft 3 is maintained.

In the present embodiment, when the hydraulic oil control valve 11 is in the first operating state or the second operating state, the hydraulic oil is returned from the drain oil passage side to the retard supply oil passage RRs or the advance supply oil passage RAs through the recycle oil passage Rre. In this way, the hydraulic oil, which is discharged from the advance chambers 202 or the retard chambers 201, can be reused.

Moreover, when the hydraulic oil control valve 11 is in the first operating state or the second operating state, the recycle check valve 81 limits backflow of the hydraulic oil from each supply oil passage side toward the drain oil passage in the recycle oil passage Rre.

Figure 5:
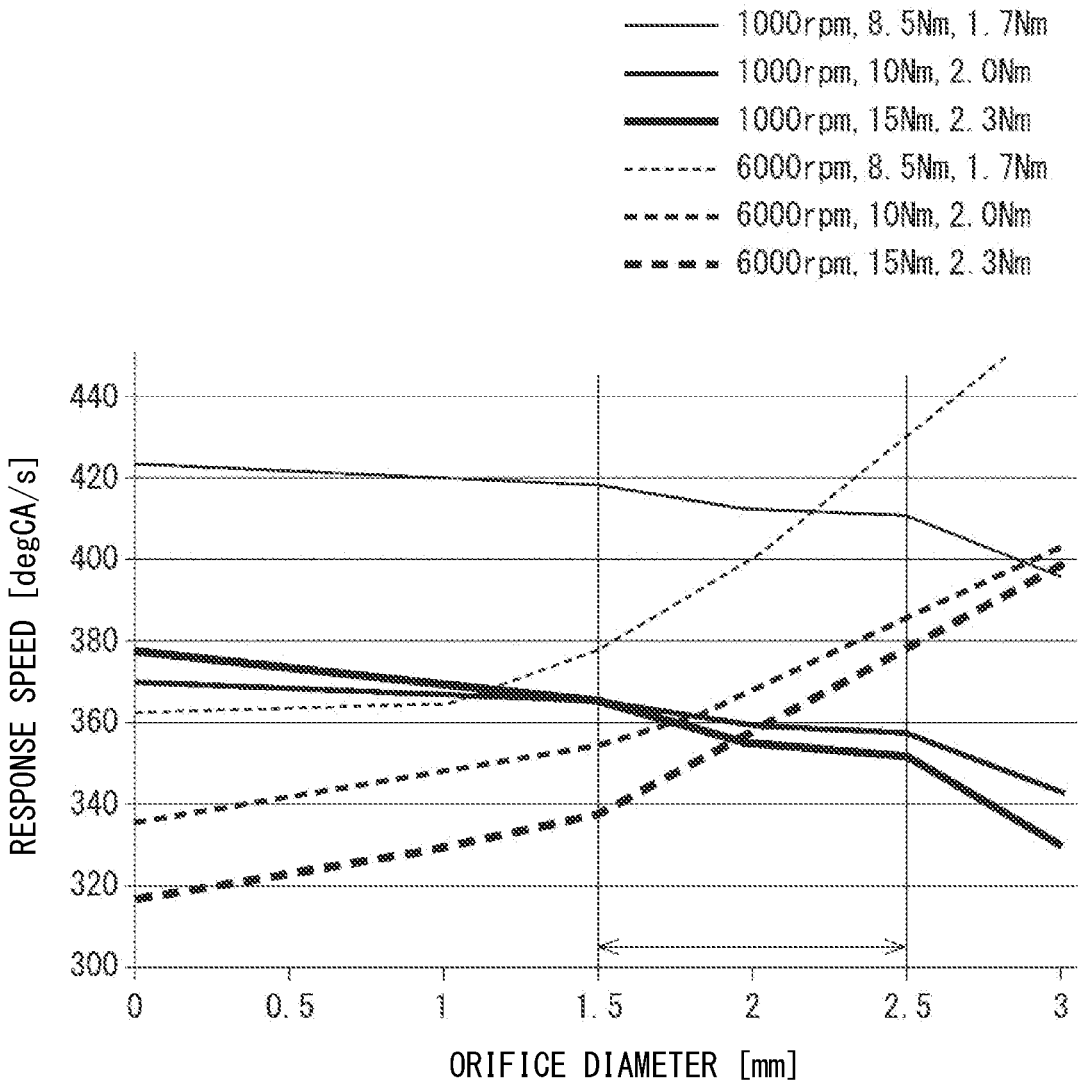
FIG. 5 is a diagram indicating a relationship between an orifice diameter of a drain flow restrictor and a response speed of a phase shifter at predetermined rotational speeds of an internal combustion engine.

FIG. 5 is a diagram indicating a relationship between an orifice diameter (mm), which is a diameter of the drain flow restrictor AD, and a response speed (degCA/s) of the phase shifter PC at a low rotational speed (1000 rpm) and a high rotational speed (6000 rpm) of the engine 1. Here, the response speed (degCA/s) of the phase shifter PC corresponds to the rotational speed of the vane rotor 30 relative to the housing 20.

FIG. 5 indicates the relationship between the orifice diameter (mm) and the response speed (degCA/s) at the low rotational speed (1000 rpm) and the high rotational speed (6000 rpm) of the engine 1 for a case where the cam torque amplitude and the generated torque are 8.5 Nm and 1.7 Nm, respectively, a case where the cam torque amplitude and the generated torque are 10 Nm and 2.0 Nm, respectively, and a case where the cam torque amplitude and the generated torque are 15 Nm and 2.3 Nm, respectively. Here, the cam torque amplitude corresponds to an average value of the positively and negatively changing torques inputted to the camshaft 3. The generated torque is a torque generated between the housing 20 and the vane rotor 30 per 100 kPa of applied hydraulic pressure to the retard chambers 201 and the advance chamber 202, which serve as hydraulic chambers.

As shown in FIG. 5, when the rotational speed of the engine 1 is low (1000 rpm), it can be seen that the response speed of the phase shifter PC decreases as the orifice diameter increases, i.e., as the passage cross-sectional area of the drain flow restrictor AD increases. Also, it can be seen that when the rotational speed of the engine 1 is high (6000 rpm), the response speed of the phase shifter PC improves as the orifice diameter increases. As shown in FIG. 5, in a range where the orifice diameter is approximately 1.5 mm to 2.5 mm, the response speed of the phase shifter PC at the low rotational speed (1000 rpm) of the engine 1 and the response speed of the phase shifter PC at the high rotational speed (6000 rpm) of the engine 1 are reversed. Also, in the range where the orifice diameter is approximately 1.5 mm to 2.5 mm, the response speed of the phase shifter PC at the low rotational speed (1000 rpm) of the engine 1 and the response speed of the phase shifter PC at the high rotational speed (6000 rpm) of the engine 1 are relatively high.

The results shown in FIG. 5 indicates that when the orifice diameter is in the range of 1.5 mm to 2.5 mm, the response speed of the phase converter PC can be improved regardless of the rotational speed of the engine 1.

As mentioned above, in the present embodiment, the orifice diameter, which is the diameter of the drain flow restrictor AD, is set in the range of 1.5 mm to 2.5 mm. Therefore, the response speed of the phase shifter PC can be improved regardless of the rotational speed of the engine 1.

As described above, according to the present embodiment, there is provided the valve timing adjustment device 10 configured to adjust the valve timing of the intake valves 4 of the engine 1. The valve timing adjustment device 10 includes the phase shifter PC and the hydraulic oil controller OC.

The phase shifter PC includes the retard chambers 201 and the advance chambers 202. The phase shifter PC is configured to adjust the valve timing of the intake valves 4 by shifting the rotational phase between the crankshaft 2 and the camshaft 3 of the engine 1 with the hydraulic oil supplied from the hydraulic oil supply source OS to the retard chambers 201 and the advance chambers 202.

The hydraulic oil control valve 11 (serving as the hydraulic oil controller OC) is configured to control the flow of the hydraulic oil supplied to the retard chambers 201 and the advance chambers 202 by controlling the hydraulic oil flowing in the retard supply oil passage RRs, which connects between the hydraulic oil supply source OS and the retard chambers 201, and the hydraulic oil flowing in the advance supply oil passage RAs, which connects between the hydraulic oil supply source OS and the advance chambers 202.

The hydraulic oil control valve 11 includes the drain ports PD, the partition PRsd, the partition PAsd, the recycle oil passage Rre and the drain flow restrictor AD. The drain ports PD are connected to the oil discharge portion OD that is configured to store the hydraulic oil discharged from the retard chambers 201 or the advance chambers 202. Each of the partition PRsd and the partition PAsd partitions between the corresponding one of the retard drain oil passage RRd and the advance drain oil passage RAd and the corresponding one of the retard supply oil passage RRs and the advance supply oil passage RAs. Here, each of the retard drain oil passage RRd and the advance drain oil passage RAd connects between the oil discharge portion OD and the corresponding ones of the retard chambers 201 and the advance chambers 202. The recycle oil passage Rre connects between: the portion of each of the retard drain oil passage (serving as the drain oil passage) RRd and the advance drain oil passage (serving as the drain oil passage) RAd located between the drain ports PD and the corresponding one of the partition PRsd and the partition PAsd; and the retard supply oil passage RRs or the advance supply oil passage RAs. With this configuration, the hydraulic oil can be reused by re-supplying a portion of the hydraulic oil, which is discharged from the advance chambers 202 or the retard chambers 201 and flows in the drain oil passage RRd, RAd, to the retard chambers 201 or the advance chambers 202 through the recycle oil passage Rre.

The drain flow restrictor AD is formed in the retard drain oil passage (serving as the drain oil passage) RRd and the advance drain oil passage (serving as the drain oil passage) RAd at the location between: the partition PRsd or the partition PAsd; and the drain ports PD. A passage cross-sectional area of the drain flow restrictor AD is smaller than a smallest passage cross-sectional area of the recycle oil passage Rre and is constant. With this configuration, it is possible to increase the amount of hydraulic oil, which is re-supplied to the retard chambers 201 or the advance chambers 202 through the recycle oil passage Rre, while reducing the amount of hydraulic oil discharged to the oil discharge portion OD through the drain flow restrictor AD. Therefore, the responsiveness of the valve timing adjustment device 10 can be improved.

Furthermore, in the present embodiment, the retard drain oil passage (serving as the drain oil passage) RRd, the advance drain oil passage (serving as the drain oil passage) RAd and the recycle oil passage Rre are connected to the partition PRsd and the partition PAsd, which are common to the retard drain oil passage RRd, the advance drain oil passage RAd and the recycle oil passage Rre. In this way, the partition PRsd and the partition PAsd do not form a junction between the recycle oil passage Rre and the drain oil passage so that the configuration of the partition PRsd and of the partition PAsd can be simplified.

Furthermore, in the present embodiment, the hydraulic oil controller OC includes the spool 60 which serves as a tubular member that is shaped in a tubular form. The retard drain oil passage (serving as the drain oil passage) RRd and the advance drain oil passage (serving as the drain oil passage) RAd extend on the radially outer side (the specific space Ss) and the radially inner side (the inside space of the spool 60) of the spool 60. The drain flow restrictor AD extends through the wall of the spool 60 in the radial direction and connects between the drain oil passage located on the radially outer side of the spool 60 and the drain oil passage located on the radially inner side of the spool 60. As described above, the connection hole (the drain opening Od1) of the drain oil passage, which extends on the inner side and the outer side of the spool 60 shaped in the tubular form, is formed as the drain flow restrictor AD so that the drain flow restrictor AD can be easily formed. Furthermore, since the drain flow restrictor AD extends through the wall of the spool 60 in the radial direction, it is possible to limit occurrence of the positional change of the spool 60 relative to the sleeve 400 caused by the fluid force exerted to the spool 60 in the axial direction.

Furthermore, in the present embodiment, the hydraulic oil controller OC includes: the sleeve 400 which is shaped in the tubular form; and the spool 60 which is shaped in the tubular form and is configured to reciprocate in the axial direction at the inside of the sleeve 400 to control the flow of the hydraulic oil to be supplied to the retard chambers 201 and the advance chambers 202. The drain flow restrictor AD is formed only at the spool 60 among the spool 60 and the sleeve 400. With this configuration, it is possible to limit a change in the axial position of the spool 60 relative to the sleeve 400 caused by a fluid force generated by a sudden pressure change around the drain flow restrictor AD.

Furthermore, in the present embodiment, the drain flow restrictor AD is formed at the spool 60. The inside space of the spool 60 is communicated with the drain ports PD. In this way, the center portion of the spool 60, which is a rotating body, is formed as the portion of the drain oil passage so that it is possible to implement the structure in which the air, which is drawn into the spool 60 by the action of the centrifugal force, can be more likely to be retained in the drain oil passage. Thus, it is possible to limit intrusion of the air into the retard chambers 201 or the advance chambers 202.

Furthermore, in the present embodiment, the passage cross-sectional area of the drain flow restrictor AD is set to be in the range of 1.77 $mm^2$ to 4.91 $mm^2$. Therefore, the response speed of the phase shifter PC can be improved regardless of the rotational speed of the engine 1 (see FIG. 5).

Furthermore, in the present embodiment, the drain flow restrictor AD has the passage cross-section that is shaped in the form of the circle. Therefore, the drain flow restrictor AD can be easily formed using a basic tool such as a drill.

Second Embodiment

Figure 6:
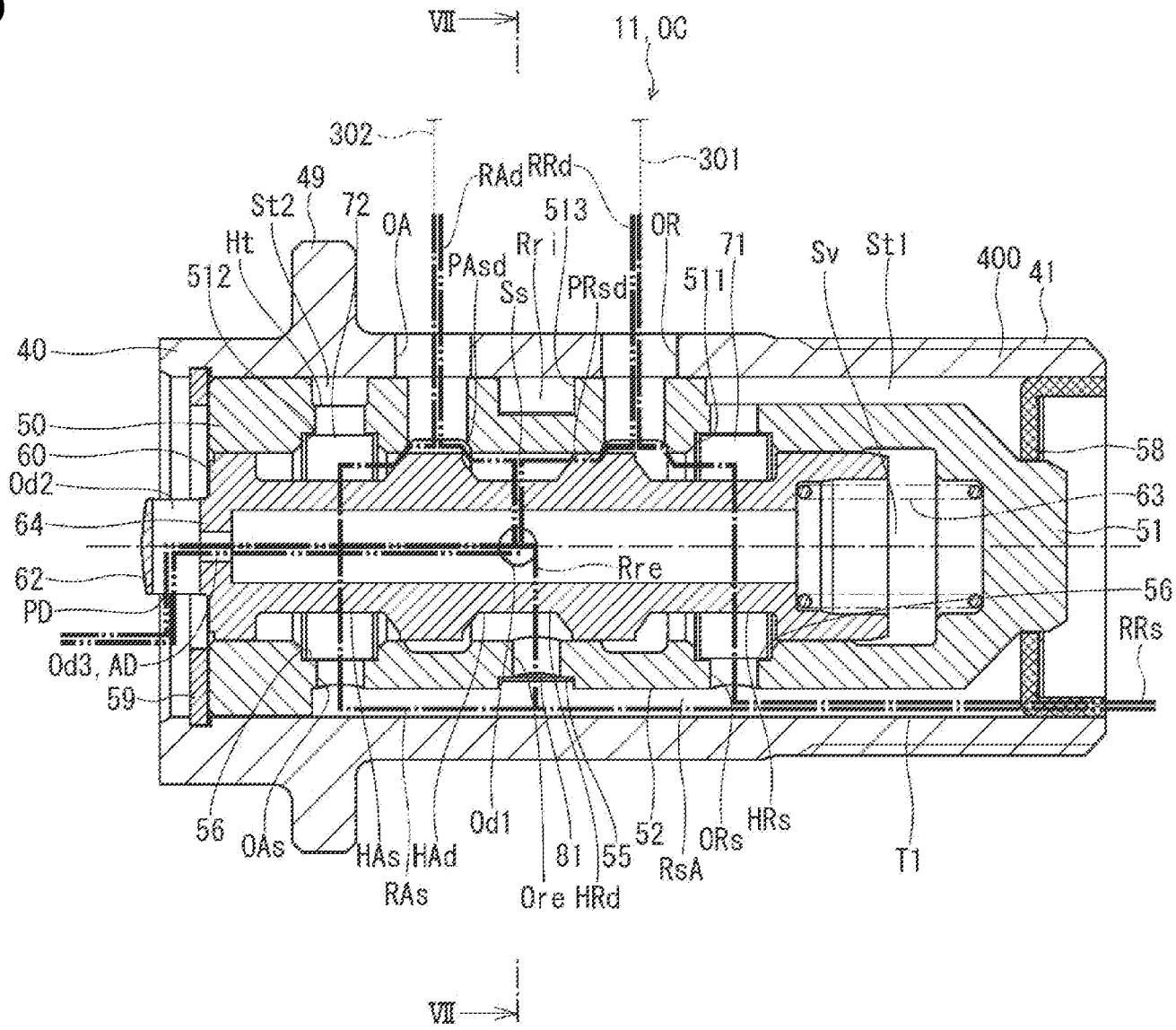
FIG. 6 is a cross-sectional view illustrating a hydraulic oil controller of a valve timing adjustment device according to a second embodiment.

FIG. 6 illustrates a portion of a valve timing adjustment device according to a second embodiment. The second embodiment differs from the first embodiment with respect to the configuration of the spool 60.

In the second embodiment, the spool 60 includes a partition wall 64 and a drain opening Od3. The partition wall 64 partitions between the inside space of the spool 60 and the drain openings Od2, i.e., the drain ports PD. The drain opening Od3 is formed through the partition wall 64 such that the drain opening Od3 communicates between the inside space of the spool 60 and the drain openings Od2, i.e., the drain ports PD. The drain opening Od3 extends in the axial direction of the spool 60.

Figure 7:
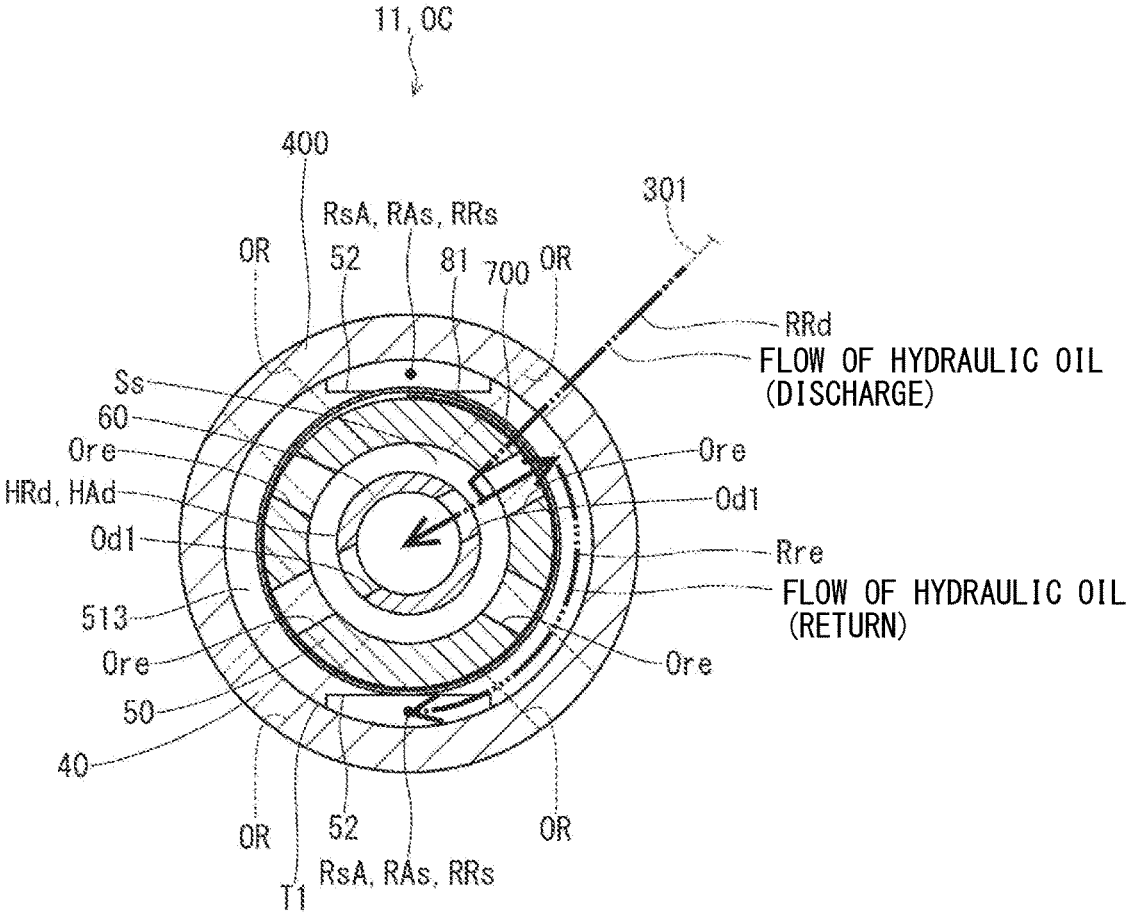
FIG. 7 is a cross-sectional view taken along line IV-IV in FIG. 6.

In the present embodiment, the number of the drain openings Od1 is two, and these drain openings Od1 are arranged at equal intervals along the spool 60 in the circumferential direction (see FIG. 7).

In the present embodiment, the drain flow restrictor AD corresponds to the drain opening Od3.

A passage cross-sectional area of the drain flow restrictor AD is smaller than a smallest passage cross-sectional area of the recycle oil passage Rre and is constant regardless of a relative position of the spool 60 relative to the sleeve 400. Here, the passage cross-sectional area of the drain flow restrictor AD corresponds to a cross-sectional area of the drain flow restrictor AD, i.e., the drain opening Od3, which is perpendicular to an axis of the drain opening Od3. Furthermore, the smallest passage cross-sectional area of the recycle oil passage Rre corresponds to a sum of cross-sectional areas of the four recycle openings Ore of the recycle oil passage Rre, each of which is perpendicular to an axis of the recycle opening Ore (see FIG. 7). A sum of the passage cross-sectional areas of the drain ports PD, i.e., the drain openings Od2 is larger than the passage cross-sectional area of the drain flow restrictor AD, i.e., the drain opening Od3.

Even in the second embodiment, similar to the first embodiment, it is possible to increase the amount of hydraulic oil, which is re-supplied to the retard chambers 201 or the advance chambers 202 through the recycle oil passage Rre, while reducing the amount of hydraulic oil discharged to the oil discharge portion OD through the drain flow restrictor AD. Therefore, the responsiveness of the valve timing adjustment device 10 can be improved.

Third Embodiment

Figure 8:
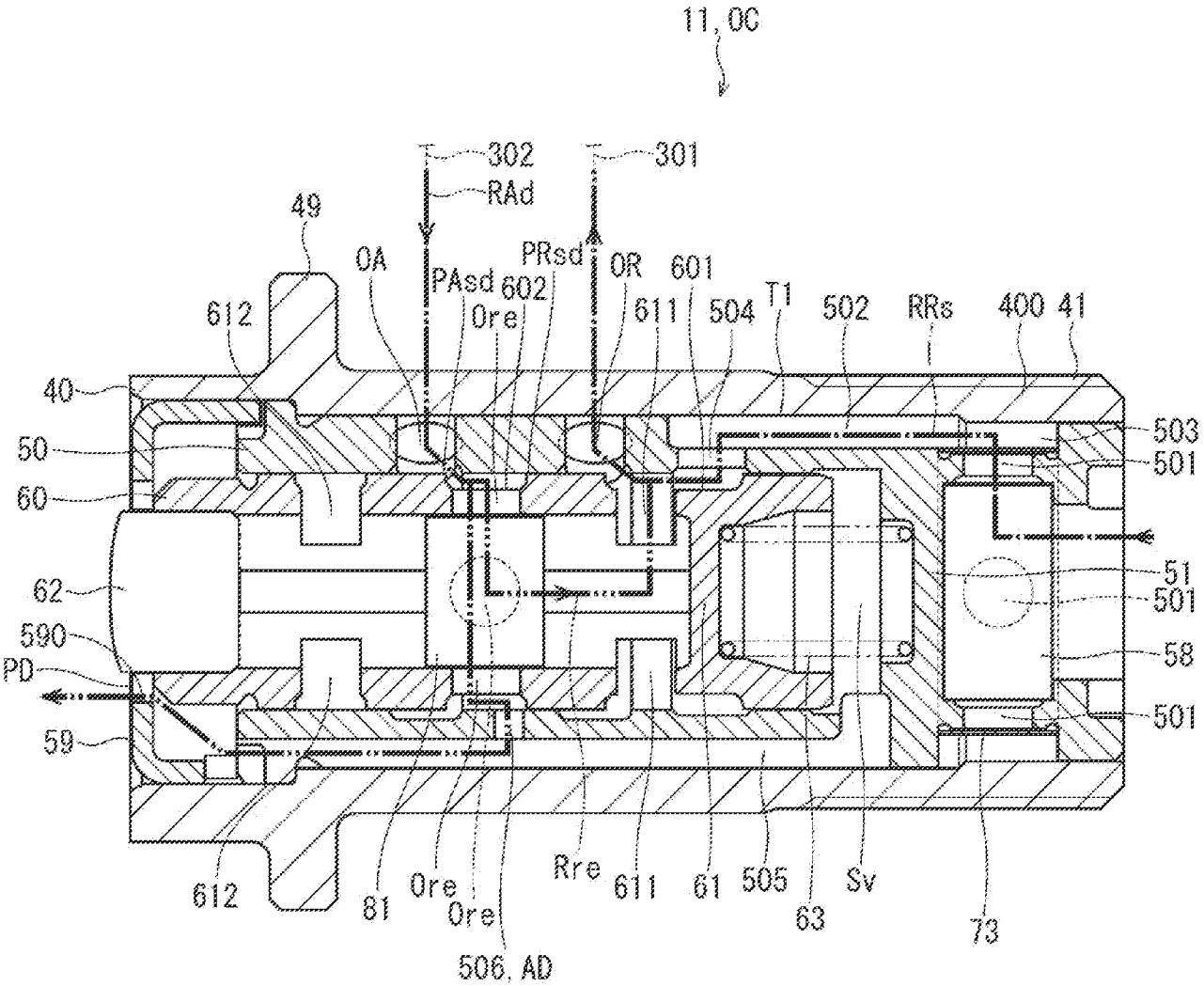
FIG. 8 is a cross-sectional view illustrating a hydraulic oil controller of a valve timing adjustment device according to a third embodiment.

FIG. 8 illustrates a portion of a valve timing adjustment device according to a third embodiment. The third embodiment differs from the first embodiment with respect to the configurations of the sleeve 400 and the spool 60.

In the present embodiment, the inner sleeve 50 includes a plurality of supply flow passages 501, an axial flow passage 502, a circumferential flow passage 503, a radial flow passage 504, a breathing hole 505 and a drain hole 506.

The supply flow passages 501 are arranged one after another along the inner sleeve 50 in the circumferential direction and communicate between an inner wall and an outer wall of an end portion of the inner sleeve 50 which is located on the sleeve sealing portion 51 side. The supply flow passages 501 are located on a side of the sleeve sealing portion 51 which is opposite to the spool 60.

The axial flow passage 502 is radially inwardly recessed at the outer wall of the end portion of the inner sleeve 50 located on the sleeve sealing portion 51 side and extends in the axial direction.

The circumferential flow passage 503 is shaped in an annular form such that the circumferential flow passage 503 is radially inwardly recessed at the outer wall of the end portion of the inner sleeve 50 located on the sleeve sealing portion 51 side and extends in the circumferential direction. The circumferential flow passage 503 connects between the supply flow passages 501 and the axial flow passage 502.

The radial flow passage 504 communicates between the outer wall and the inner wall of the inner sleeve 50. The radial flow passage 504 is connected to an end portion of the axial flow passage 502, which is opposite to the circumferential flow passage 503.

The breathing hole 505 is radially inwardly recessed at the outer wall of the inner sleeve 50 and axially extends to the end portion of the inner sleeve 50 located on the retaining portion 59 side. One end of the breathing hole 505 is connected to the variable volume space Sv. The other end of the breathing hole 505 is connected to a drain hole 590 formed at a center of the retaining portion 59.

The drain hole 506 is formed at the inner sleeve 50 such that the drain hole 506 communicates between the inner wall and the outer wall of the inner sleeve 50. The drain hole 506 is connected to the breathing hole 505.

The spool 60 includes the spool sealing portion 61, the spool sealing portion 62, a supply recess 601, a drain recess 602, a plurality of primary control oil passages 611, a plurality of secondary control oil passages 612 and a plurality of recycle openings Ore.

The spool sealing portion 61 closes an end portion of the spool 60 located on the sleeve sealing portion 51 side. The variable volume space Sv is formed between the spool sealing portion 61 and the sleeve sealing portion 51, and the spring 63 is installed in the variable volume space Sv.

The spool sealing portion 62 closes the end portion of the spool 60 located on the retaining portion 59 side. The spool sealing portion 62 is located at the inside of the drain hole 590 of the retaining portion 59. The drain port PD, which is connected to the oil discharge portion OD, is formed between the spool sealing portion 62 and the drain hole 590.

The supply recess 601 is shaped in an annular form such that the supply recess 601 is radially inwardly recessed at the outer wall of the end portion of the spool 60 located on the spool sealing portion 61 side and extends in the circumferential direction. The supply recess 601 can be connected to the radial flow passage 504.

The drain recess 602 is shaped in an annular form such that the drain recess 602 is radially inwardly recessed at the outer wall of the spool 60. The drain recess 602 is located on the spool sealing portion 62 side of the supply recess 601. The drain recess 602 is connected to the breathing hole 505 through the drain hole 506.

The primary control oil passages 611 communicate between an outer wall and an inner wall of the end portion of the spool 60 located on the spool sealing portion 61 side. The primary control oil passages 611 are located on the side of the spool sealing portion 61 where the spool sealing portion 62 is placed, and the primary control oil passages 611 are connected to the supply recess 601.

The secondary control oil passages 612 communicate between the outer wall and the inner wall of the end portion of the spool 60 located on the spool sealing portion 62 side.

The number of recycle openings Ore is four, and these recycle openings Ore are arranged at equal intervals along the spool 60 in the circumferential direction and communicate between the outer wall and the inner wall of the spool 60. The recycle openings Ore are connected to the drain recess 602.

The spool 60 is movable in the axial direction from a position (see FIG. 8), at which the spool 60 contacts the retaining portion 59, to a position (not shown), at which the spool 60 contacts the sleeve sealing portion 51.

When the spool 60 is in contact with the retaining portion 59 (see FIG. 8), the supply recess 601 is communicated with the retard openings OR, and the advance openings OA are communicated with the drain recess 602.

When the spool 60 is in contact with the sleeve sealing portion 51 (not shown), the supply recess 601 is communicated with the advance openings OA through the primary control oil passages 611 and the secondary control oil passages 612, and the retard openings OR are communicated with the drain recess 602.

When the spool 60 is positioned at an intermediate position between the retaining portion 59 and the sleeve sealing portion 51 (not shown), the retard openings OR and the advance openings OA are closed by the outer wall of the spool 60.

The retard supply oil passage RRs is configured to connect between the hydraulic oil supply source OS and the retard chambers 201 through the supply flow passages 501, the circumferential flow passage 503, the axial flow passage 502, the radial flow passage 504, the supply recess 601, the retard openings OR and the retard oil passages 301 (see FIG. 8).

The advance supply oil passage RAs is configured to connect between the hydraulic oil supply source OS and the advance chambers 202 through the supply flow passages 501, the circumferential flow passage 503, the axial flow passage 502, the radial flow passage 504, the supply recess 601, the primary control oil passages 611, the inside space of the spool 60, the secondary control oil passages 612, the advance openings OA and the advance oil passages 302 (not shown).

The retard drain oil passage (serving as the drain oil passage) RRd is configured to connect between the retard chambers 201 and the oil discharge portion OD through the retard openings OR, the drain recess 602, the drain hole 506, the breathing hole 505 and the drain port PD (not shown).

The advance drain oil passage (serving as the drain oil passage) RAd is configured to connect between the advance chambers 202 and the oil discharge portion OD through the advance openings OA, the drain recess 602, the drain hole 506, the breathing hole 505 and the drain port PD (see FIG. 8).

The partition PRsd is formed at an end portion of the drain recess 602 located on the spool sealing portion 61 side in the spool 60. The partition PRsd partitions between the retard drain oil passage RRd and the retard supply oil passage RRs.

The partition PAsd is formed at an end portion of the drain recess 602 located on the spool sealing portion 62 side in the spool 60. The partition PAsd partitions between the advance drain oil passage RAd and the advance supply oil passage RAs.

The recycle oil passage Rre connects between the advance drain oil passage RAd at the drain recess 602 and the retard supply oil passage RRs at the supply recess 601 through the recycle openings Ore, the inside space of the spool 60 and the primary control oil passages 611 (see FIG. 8).

Furthermore, the recycle oil passage Rre connects between the retard drain oil passage RRd at the drain recess 602 and the advance supply oil passage RAs through the recycle openings Ore, the inside space of the spool 60 and the secondary control oil passages 612 (not shown).

In the present embodiment, the drain flow restrictor AD corresponds to the drain hole 506. Specifically, the drain flow restrictor AD is formed at the inner sleeve 50. The drain flow restrictor AD is configured to communicate between the inside space of the inner sleeve 50 and the breathing hole 505, i.e., the radially outer side of the inner sleeve 50. The drain flow restrictor AD extends through the wall of the inner sleeve 50 in the radial direction, and the number of the drain flow restrictor AD is one all around the inner sleeve 50 in the circumferential direction. Here, the inner sleeve 50 corresponds to a tubular member.

As described above, the drain flow restrictor AD is formed in the retard drain oil passage (serving as the drain oil passage) RRd and the advance drain oil passage (serving as the drain oil passage) RAd at the location between: the partition PRsd or the partition PAsd; and the drain port PD.

A passage cross-sectional area of the drain flow restrictor AD is smaller than a smallest passage cross-sectional area of the recycle oil passage Rre and is constant regardless of a relative position of the spool 60 relative to the sleeve 400. Here, the passage cross-sectional area of the drain flow restrictor AD corresponds to a cross-sectional area of the drain flow restrictor AD, i.e., the drain hole 506, which is perpendicular to an axis of the drain hole 506. Furthermore, the smallest passage cross-sectional area of the recycle oil passage Rre corresponds to a sum of cross-sectional areas of the four recycle openings Ore of the recycle oil passage Rre, each of which is perpendicular to an axis of the recycle opening Ore. The passage cross-sectional area of the drain port PD is larger than the passage cross-sectional area of the drain flow restrictor AD, i.e., the drain hole 506.

In the present embodiment, the drain flow restrictor AD, i.e., the drain hole 506 has a passage cross-section that is shaped in a form of a circle.

In the present embodiment, an orifice diameter of the drain flow restrictor AD, i.e., a diameter of the drain hole 506 is set to be in a range of 1.5 mm to 2.5 mm. Specifically, the passage cross-sectional area of the drain flow restrictor AD is set to be in a range of 1.77 $mm^2$ to 4.91 $mm^2$.

The filter 58 is provided for the supply flow passage 501 at a location that is on the radially inner side of the inner sleeve 50. The filter 58 can capture foreign objects contained in the hydraulic oil.

A supply check valve 73 is provided for the supply flow passage 501 at a location that is on the radially outer side of the inner sleeve 50. A configuration of the supply check valve 73 is similar to that of the retard supply check valve 71 of the first embodiment and is formed by rolling a rectangular metal thin plate (serving as a single plate material) into a cylindrical tubular form. The supply check valve 73 enables flow of the hydraulic oil from the supply flow passage 501 to the circumferential flow passage 503 and limits flow of the hydraulic oil from the circumferential flow passage 503 to the supply flow passage 501.

The recycle check valve 81 is provided for the recycle openings Ore at a location that is on the radially inner side of the spool 60. A configuration of the recycle check valve 81 is similar to that of the retard supply check valve 71 of the first embodiment and is formed by rolling a rectangular metal thin plate (serving as a single plate material) into a cylindrical tubular form. The recycle check valve 81 enables flow of the hydraulic oil from the recycle openings Ore to the inside space of the spool 60 and limits flow of the hydraulic oil from the inside space of the spool 60 to the recycle openings Ore.

As described above, according to the present embodiment, the hydraulic oil control valve 11 includes the drain port PD, the partition PRsd, the partition PAsd, the recycle oil passage Rre and the drain flow restrictor AD. The drain port PD is connected to the oil discharge portion OD that is configured to store the hydraulic oil discharged from the retard chambers 201 or the advance chambers 202. Each of the partition PRsd and the partition PAsd partitions between the corresponding one of the retard drain oil passage RRd and the advance drain oil passage RAd and the corresponding one of the retard supply oil passage RRs and the advance supply oil passage RAs. Here, each of the retard drain oil passage RRd and the advance drain oil passage RAd connects between the oil discharge portion OD and the corresponding ones of the retard chambers 201 and the advance chambers 202. The recycle oil passage Rre connects between: the portion of each of the retard drain oil passage (serving as the drain oil passage) RRd and the advance drain oil passage (serving as the drain oil passage) RAd located between the drain port PD and the corresponding one of the partition PRsd and the partition PAsd; and the retard supply oil passage RRs or the advance supply oil passage RAs. With this configuration, the hydraulic oil can be reused by re-supplying a portion of the hydraulic oil, which is discharged from the advance chambers 202 or the retard chambers 201 and flows in the drain oil passage RRd, RAd, to the retard chambers 201 or the advance chambers 202 through the recycle oil passage Rre.

The drain flow restrictor AD is formed in the retard drain oil passage (serving as the drain oil passage) RRd and the advance drain oil passage (serving as the drain oil passage) RAd at the location between: the partition PRsd or the partition PAsd; and the drain port PD. A passage cross-sectional area of the drain flow restrictor AD is smaller than a smallest passage cross-sectional area of the recycle oil passage Rre and is constant. With this configuration, it is possible to increase the amount of hydraulic oil, which is re-supplied to the retard chambers 201 or the advance chambers 202 through the recycle oil passage Rre, while reducing the amount of hydraulic oil discharged to the oil discharge portion OD through the drain flow restrictor AD. Therefore, the responsiveness of the valve timing adjustment device 10 can be improved.

Furthermore, in the present embodiment, the hydraulic oil controller OC includes the inner sleeve 50 which serves as a tubular member that is shaped in a tubular form. The retard drain oil passage (serving as the drain oil passage) RRd and the advance drain oil passage (serving as the drain oil passage) RAd extend on the radially outer side (the breathing hole 505) and the radially inner side (the drain recess 602) of the inner sleeve 50. The drain flow restrictor AD extends in the wall of the inner sleeve 50 in the radial direction and connects between the drain oil passage located on the radially outer side of the inner sleeve 50 and the drain oil passage located on the radially inner side of the inner sleeve 50. As described above, the connection hole (the drain hole 506) of the drain oil passage, which extends on the inner side and the outer side of the inner sleeve 50 shaped in the tubular form, is formed as the drain flow restrictor AD so that the drain flow restrictor AD can be easily formed.

Furthermore, in the present embodiment, the drain flow restrictor AD is formed only at the inner sleeve 50 of the sleeve 400 among the spool 60 and the sleeve 400. With this configuration, it is possible to limit a change in the axial position of the spool 60 relative to the sleeve 400 caused by a fluid force generated by a sudden pressure change around the drain flow restrictor AD.

Furthermore, in the present embodiment, the drain flow restrictor AD is formed at the inner sleeve 50 of the sleeve 400. Therefore, in the structure where the drain oil is discharged from the radially inner side to the radially outer side of the inner sleeve 50, the drain flow restrictor AD can be easily formed.

Fourth Embodiment

Figure 9:
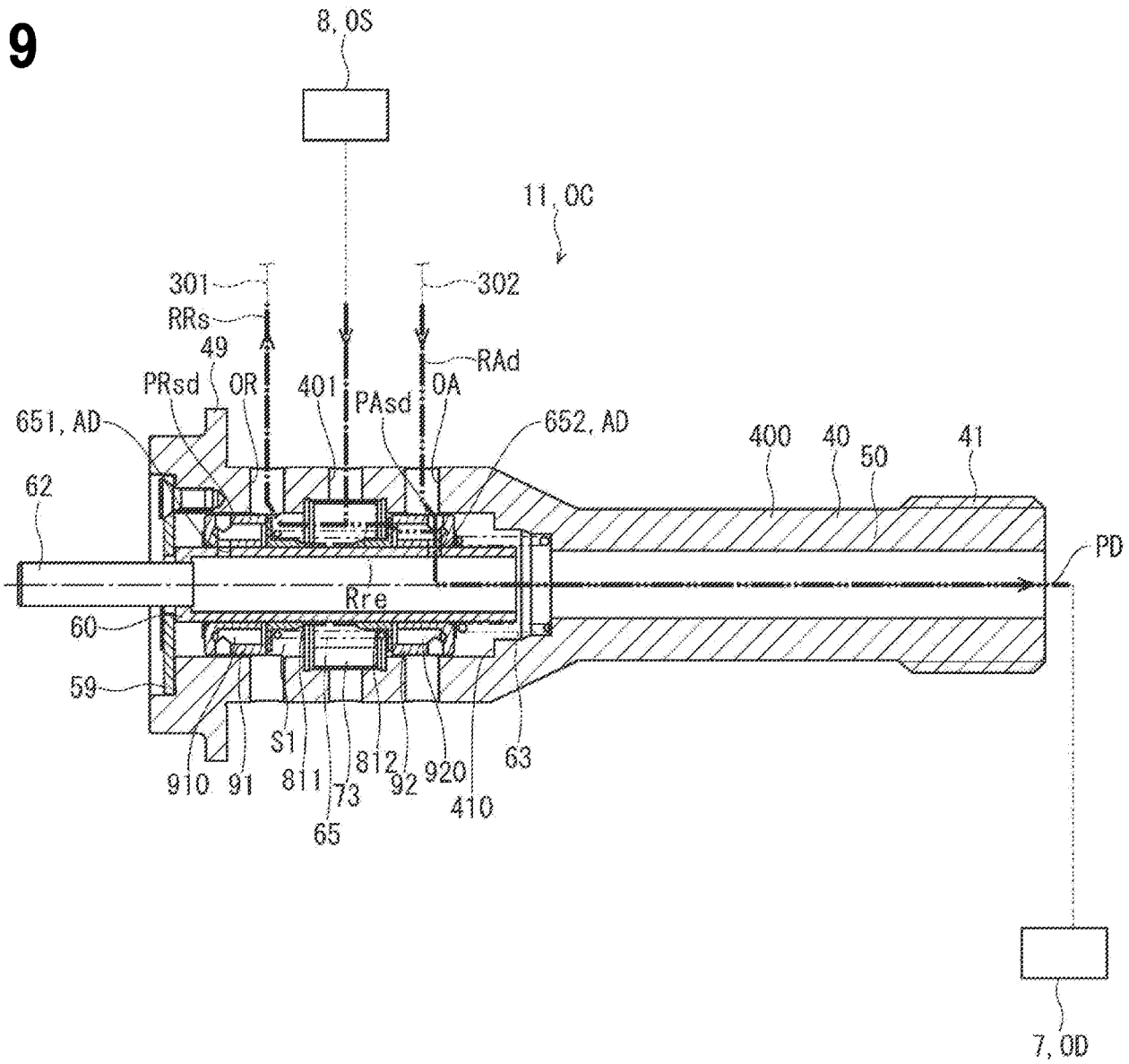
FIG. 9 is a cross-sectional view illustrating a hydraulic oil controller of a valve timing adjustment device according to a fourth embodiment.

FIG. 9 illustrates a portion of a valve timing adjustment device according to a fourth embodiment. The fourth embodiment differs from the first embodiment with respect to the configurations of the sleeve 400 and the spool 60.

In the present embodiment, the outer sleeve 40 and the inner sleeve 50 of the sleeve 400 are formed integrally in one-piece.

The sleeve 400 includes a plurality of sleeve supply holes 401. The sleeve supply holes 401 communicate between an outer wall and an inner wall of the sleeve 400 at a location between the retard openings OR and the advance openings OA. In the present embodiment, the retard openings OR are located on the retaining portion 49 side of the sleeve supply holes 401, and the advance openings OA are located on the threaded portion 41 side of the sleeve supply holes 401.

The drain port PD is formed at an end portion of the sleeve 400 which is opposite to the retaining portion 59. The drain port PD is connected to the oil discharge portion OD.

The spool 60 is shaped generally in a cylindrical tubular form. The spool sealing portion 62 is shaped generally in a cylindrical rod form and closes an end portion of the spool 60 located on the retaining portion 59 side.

A retard recycle oil passage member 91 and an advance recycle oil passage member 92 are installed on the radially outer side of the spool 60.

The retard recycle oil passage member 91 is shaped in a tubular form, and an inner wall of the retard recycle oil passage member 91 is fitted to an outer wall of an end portion of the spool 60 located on the spool sealing portion 62 side. The advance recycle oil passage member 92 is shaped in a tubular form, and an inner wall of the advance recycle oil passage member 92 is fitted to an outer wall of the end portion of the spool 60 located on the threaded portion 41 side.

The retard recycle oil passage member 91 includes a plurality of retard recycle oil passages 910. Each of the retard recycle oil passages 910 is configured to connect an end surface of the retard recycle oil passage member 91 located on the advance recycle oil passage member 92 side to an outer wall and an inner wall of the retard recycle oil passage member 91. The retard recycle oil passages 910 are arranged one after another along the retard recycle oil passage member 91 in the circumferential direction.

The advance recycle oil passage member 92 includes a plurality of advance recycle oil passages 920. Each of the advance recycle oil passages 920 is configured to connect an end surface of the advance recycle oil passage member 92 located on the retard recycle oil passage member 91 side to an outer wall and an inner wall of the advance recycle oil passage member 92. The advance recycle oil passages 920 are arranged one after another along the advance recycle oil passage member 92 in the circumferential direction.

The spool 60 includes a spool drain hole 651 and a spool drain hole 652. The spool drain hole 651 connects between the inner wall of the spool 60 and the retard recycle oil passages 910, and the number of spool drain hole 651 is one all around the spool 60 in the circumferential direction. The spool drain hole 652 connects between the inner wall of the spool 60 and the advance recycle oil passages 920, and the number of spool drain hole 652 is one all around the spool 60 in the circumferential direction. The inside space of the spool 60 is communicated with the drain port PD.

When the spool 60 is moved relative to the sleeve 400 in the axial direction, the outer wall of the retard recycle oil passage member 91 and the outer wall of the advance recycle oil passage member 92 slide along the inner wall of the sleeve 400.

The spring 63 is installed between the advance recycle oil passage member 92 and a step surface of the inner wall of the sleeve 400 and urges the spool 60 toward the retaining portion 59.

The spool 60 is movable in the axial direction from a position (see FIG. 9), at which the spool 60 contacts the retaining portion 59, to a position (not shown), at which the advance recycle oil passage member 92 contacts a sleeve step surface 410 formed at the inner wall of the sleeve 400.

When the spool 60 is in contact with the retaining portion 59 (see FIG. 9), the sleeve supply holes 401 are communicated with the retard openings OR through a space S1, which is shaped in a cylindrical form and is located between the outer wall of the spool 60 and the inner wall of the sleeve 400 at a location between the retard recycle oil passage member 91 and the advance recycle oil passage member 92. Furthermore, at this time, the advance openings OA are communicated with the advance recycle oil passages 920.

When the advance recycle oil passage member 92 is in contact with the sleeve step surface 410 (not shown), the sleeve supply holes 401 are communicated with the advance openings OA through the space S1. Furthermore, at this time, the retard openings OR are communicated with the retard recycle oil passages 910.

When the spool 60 is spaced from the retaining portion 59 by a predetermined distance, and the advance recycle oil passage member 92 is spaced from the sleeve step surface 410 by a predetermined distance (not shown), the retard openings OR are closed by the outer wall of the retard recycle oil passage member 91, and the advance openings OA are closed by the outer wall of the advance recycle oil passage member 92.

The retard supply oil passage RRs is configured to connect the hydraulic oil supply source OS to the retard chambers 201 through the sleeve supply holes 401, the space S1 and the retard openings OR (see FIG. 9).

The advance supply oil passage RAs is configured to connect the hydraulic oil supply source OS to the advance chambers 202 through the sleeve supply holes 401, the space S1 and the advance openings OA (not shown).

The retard drain oil passage RRd (serving as the drain oil passage) is configured to connect the retard chambers 201 to the oil discharge portion OD through the retard openings OR, the retard recycle oil passages 910, the spool drain hole 651, the inside space of the spool 60 and the drain port PD (not shown).

The advance drain oil passage RAd (serving as the drain oil passage) is configured to connect the advance chambers 202 to the oil discharge portion OD through the advance openings OA, the advance recycle oil passages 920, the spool drain hole 652, the inside space of the spool 60 and the drain port PD (see FIG. 9).

The partition PRsd is formed at the outer wall of the retard recycle oil passage member 91 at a location where the openings of the retard recycle oil passages 910 are placed. The partition PRsd partitions between the retard drain oil passage RRd and the retard supply oil passage RRs.

The partition PAsd is formed at the outer wall of the advance recycle oil passage member 92 at a location where the openings of the advance recycle oil passages 920 are placed. The partition PAsd partitions between the advance drain oil passage RAd and the advance supply oil passage RAs.

The recycle oil passage Rre connects the advance drain oil passage RAd in the advance recycle oil passages 920 to the retard supply oil passage RRs in the space S1 through the advance recycle oil passages 920 (see FIG. 9).

Furthermore, the recycle oil passage Rre connects the retard drain oil passage RRd in the retard recycle oil passages 910 to the advance supply oil passage RAs in the space S1 through the retard recycle oil passages 910 (not shown).

In the present embodiment, the drain flow restrictor AD corresponds to each of the spool drain hole 651 and the spool drain hole 652. Specifically, the drain flow restrictors AD are formed at the spool 60. The drain flow restrictors AD are configured to communicate between the inside space of the spool 60 to the outside of the spool 60. The drain flow restrictors AD extend through the wall of the spool 60 in the radial direction. Here, the spool 60 corresponds to a tubular member.

As described above, the drain flow restrictors AD are respectively formed in the retard drain oil passage (serving as the drain oil passage) RRd and the advance drain oil passage (serving as the drain oil passage) RAd at the location between: the partition PRsd or the partition PAsd; and the drain port PD.

A passage cross-sectional area of the drain flow restrictor AD is smaller than a smallest passage cross-sectional area of the recycle oil passage Rre and is constant regardless of a relative position of the spool 60 relative to the sleeve 400. Here, the passage cross-sectional area of the drain flow restrictor AD corresponds to a cross-sectional area of the drain flow restrictor AD, i.e., the spool drain hole 651 or the spool drain hole 652, which is perpendicular to an axis of the spool drain hole 651 or the spool drain hole 652. Furthermore, the smallest passage cross-sectional area of the recycle oil passage Rre corresponds to a cross-sectional area of the advance recycle oil passages 920 or the retard recycle oil passages 910 of the recycle oil passage Rre, each of which is perpendicular to an axis of the advance recycle oil passages 920 or the retard recycle oil passages 910. The passage cross-sectional area of the drain port PD is larger than the passage cross-sectional area of the drain flow restrictor AD, i.e., the spool drain hole 651 or the spool drain hole 652.

In the present embodiment, the drain flow restrictor AD, i.e., the spool drain hole 651 or the spool drain hole 652 has a passage cross-section that is shaped in a form of a circle.

In the present embodiment, an orifice diameter of the drain flow restrictor AD, i.e., a diameter of the spool drain hole 651 or the spool drain hole 652 is set to be in a range of 1.5 mm to 2.5 mm. Specifically, the passage cross-sectional area of the drain flow restrictor AD is set to be in a range of 1.77 $mm^2$ to 4.91 $mm^2$.

The supply check valve 73 is provided for the sleeve supply holes 401 at a location that is on the radially inner side of the sleeve 400. A configuration of the supply check valve 73 is similar to that of the retard supply check valve 71 of the first embodiment and is formed by rolling a rectangular metal thin plate (serving as a single plate material) into a cylindrical tubular form. The supply check valve 73 enables flow of the hydraulic oil from the sleeve supply holes 401 to the space 51 and limits flow of the hydraulic oil from the space 51 to the sleeve supply holes 401.

A retard recycle check valve 811, an advance recycle check valve 812 and a spring 65 are installed in the space 51.

The retard recycle check valve 811 is shaped in a ring form and is located on the radially outer side of the spool 60 such that the retard recycle check valve 811 is configured to contact the end surface of the retard recycle oil passage member 91 located on the advance recycle oil passage member 92 side and is configured to close the retard recycle oil passages 910. The retard recycle check valve 811 is movable relative to the spool 60 in the axial direction.

The advance recycle check valve 812 is shaped in a ring form and is located on the radially outer side of the spool 60 such that the advance recycle check valve 812 is configured to contact the end surface of the advance recycle oil passage member 92 located on the retard recycle oil passage member 91 side and is configured to close the advance recycle oil passages 920. The advance recycle check valve 812 is movable relative to the spool 60 in the axial direction.

The spring 65 is installed between the retard recycle check valve 811 and the advance recycle check valve 812. The spring 65 urges the retard recycle check valve 811 and the advance recycle check valve 812 toward the retard recycle oil passage member 91 and the advance recycle oil passage member 92, respectively.

The retard recycle check valve 811 enables flow of the hydraulic oil from the retard recycle oil passages 910 toward the space S1 and limits flow of the hydraulic oil from the space S1 toward the retard recycle oil passages 910.

The advance recycle check valve 812 enables flow of the hydraulic oil from the advance recycle oil passages 920 toward the space S1 and limits flow of the hydraulic oil from the space S1 toward the advance recycle oil passages 920.

As described above, in the present embodiment, the hydraulic oil controller OC includes the spool 60 which serves as the tubular member that is shaped in the tubular form. The retard drain oil passage (serving as the drain oil passage) RRd and the advance drain oil passage (serving as the drain oil passage) RAd extend on the radially outer side and the radially inner side (the inside space of the spool 60) of the spool 60. Each drain flow restrictor AD extends through the wall of the spool 60 in the radial direction and connects between the drain oil passage located on the radially outer side of the spool 60 and the drain oil passage located on the radially inner side of the spool 60. As described above, each of the connection holes (the spool drain hole 651 and the spool drain hole 652) of the drain oil passage, which extend on the inner side and the outer side of the spool 60 shaped in the tubular form, is formed as the drain flow restrictor AD so that the drain flow restrictor AD can be easily formed. Furthermore, since the drain flow restrictor AD extends through the wall of the spool 60 in the radial direction, it is possible to limit occurrence of a positional change of the spool 60 relative to the sleeve 400 caused by a fluid force exerted to the spool 60 in the axial direction.

Fifth Embodiment

Figure 10:
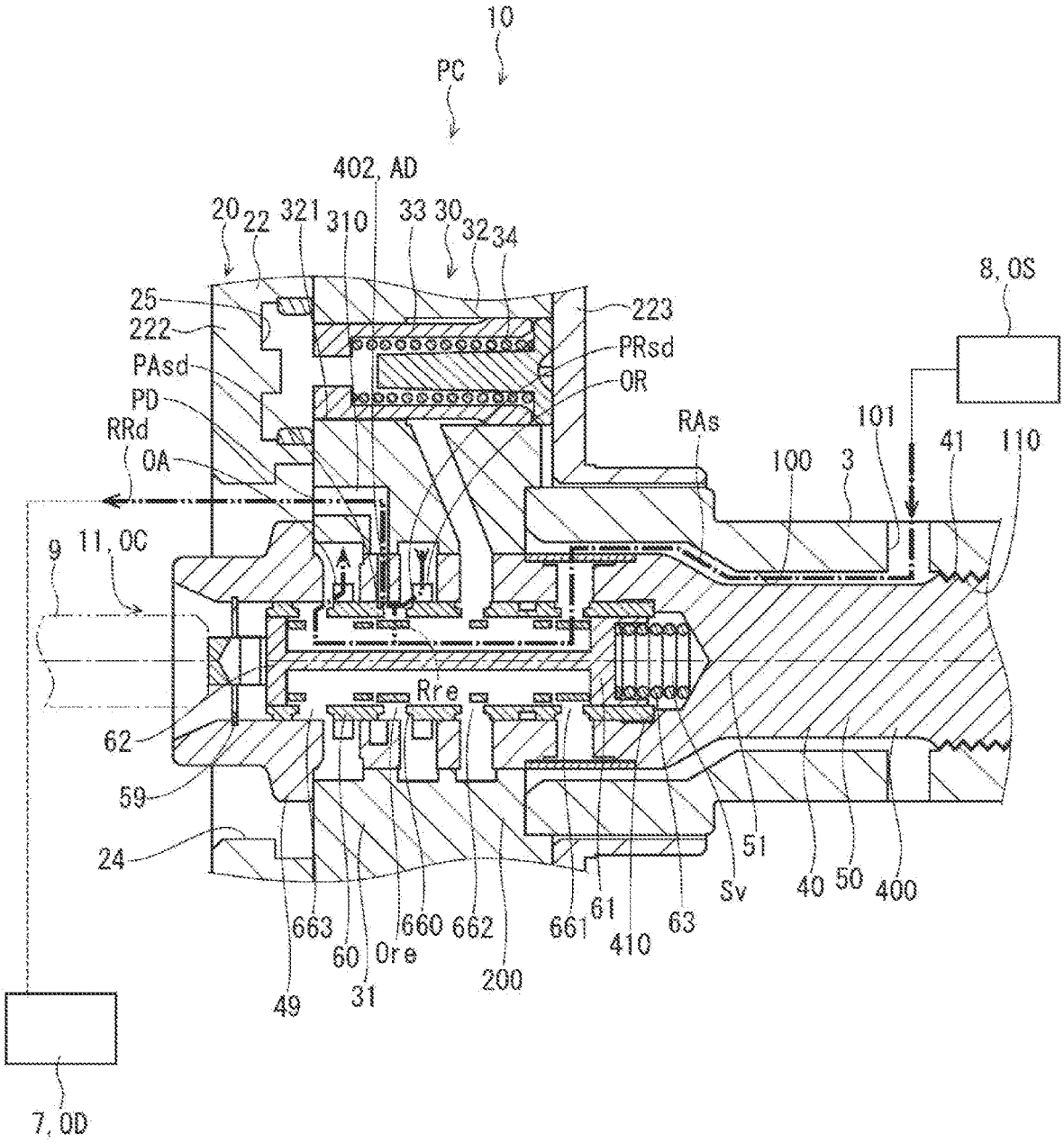
FIG. 10 is a cross-sectional view illustrating a portion of a valve timing adjustment device according to a fifth embodiment.

FIG. 10 illustrates a portion of a valve timing adjustment device according to a fifth embodiment. The fifth embodiment differs from the first embodiment with respect to the configurations of the sleeve 400 and the spool 60.

In the present embodiment, the outer sleeve 40 and the inner sleeve 50 of the sleeve 400 are formed integrally in one-piece.

The sleeve 400 includes the sleeve supply holes 401, a sleeve drain hole 402, the retard openings OR and the advance openings OA.

The sleeve supply holes 401 extend through the outer wall and the inner wall of the sleeve 400. The sleeve supply holes 401 are connected to the hydraulic oil supply source OS through a cylindrical space, which is formed between the inner wall of the shaft hole 100 and the outer wall of the sleeve 400, and the supply holes 101.

The sleeve drain hole 402 is located on the retaining portion 49 side of the sleeve supply holes 401 and communicates between the outer wall and the inner wall of the sleeve 400. A rotor drain hole 310 is formed at the vane rotor 30. The rotor drain hole 310 communicates between the sleeve drain hole 402 and an end surface of the vane rotor 30 which is opposite to the camshaft 3. The drain port PD is formed at an opening of the rotor drain hole 310 at the end surface of the vane rotor 30 which is opposite to the camshaft 3. The drain port PD is connected to the oil discharge portion OD through the opening 24.

The retard openings OR communicate between the outer wall and the inner wall of the sleeve 400 at a location between the sleeve supply holes 401 and the sleeve drain hole 402. The retard openings OR are communicated with the retard chambers 201.

The advance openings OA communicate between the outer wall and the inner wall of the sleeve 400 at a location between the sleeve drain hole 402 and the retaining portion 49. The advance openings OA are communicated with the advance chambers 202.

The spool 60 includes a plurality of spool supply holes 661, a drain recess 660, a plurality of retard holes 662, a plurality of advance holes 663 and a plurality of recycle opening Ore.

The spool supply holes 661 are arranged one after another along the spool 60 in the circumferential direction and communicate between the outer wall and the inner wall of the end portion of the spool 60 located on the spool sealing portion 61 side.

The drain recess 660 is shaped in an annular form and is located on the spool sealing portion 62 side of the spool supply holes 661. The drain recess 660 is radially inwardly recessed at the outer wall of the spool 60 and extends in the circumferential direction.

The retard holes 662 are arranged one after another along the spool 60 in the circumferential direction and communicate between the inner wall and the outer wall of the spool 60 at a location between the spool supply holes 661 and the drain recess 660.

The advance holes 663 are arranged one after another along the spool 60 in the circumferential direction and communicate between the inner wall and the outer wall of the spool 60 at a location between the drain recess 660 and the retaining portion 49.

The recycle openings Ore are arranged one after another along the spool 60 in the circumferential direction and communicate between the inner wall of the spool 60 and the drain recess 660.

The spring 63 is installed between the spool sealing portion 61 and the inner wall of the sleeve 400 and urges the spool 60 toward the retaining portion 59.

The spool 60 is movable in the axial direction from a position (not shown), at which the spool 60 contacts the retaining portion 59, to a position (see FIG. 10), at which the spool 60 contacts the sleeve step surface 410 formed at the inner wall of the sleeve 400.

When the spool 60 is in contact with the retaining portion 59 (not shown), the hydraulic oil supply source OS is communicated with the retard chambers 201 through the supply holes 101, the sleeve supply holes 401, the spool supply holes 661, the inside space of the spool 60, the retard holes 662 and the retard openings OR.

When the spool 60 is in contact with the sleeve step surface 410 (see FIG. 10), the hydraulic oil supply source OS is communicated with the advance chambers 202 through the supply holes 101, the sleeve supply holes 401, the spool supply holes 661, the inside space of the spool 60, the advance holes 663 and the advance openings OA.

When the spool 60 is positioned at an intermediate position between the retaining portion 59 and the sleeve step surface 410 (not shown), the retard openings OR and the advance openings OA are closed by the outer wall of the spool 60.

The retard supply oil passage RRs is configured to connect between the hydraulic oil supply source OS and the retard chambers 201 through the supply holes 101, the sleeve supply holes 401, the spool supply holes 661, the inside space of the spool 60, the retard holes 662 and the retard openings OR (not shown).

The advance supply oil passage RAs is configured to connect between the hydraulic oil supply source OS and the advance chambers 202 through the supply holes 101, the sleeve supply holes 401, the spool supply holes 661, the inside space of the spool 60, the advance holes 663 and the advance openings OA (see FIG. 10).

The retard drain oil passage (serving as the drain oil passage) RRd is configured to connect between the retard chambers 201 and the oil discharge portion OD through the retard openings OR, the drain recess 660, the sleeve drain hole 402, the rotor drain hole 310 and the drain port PD (see FIG. 10).

The advance drain oil passage (serving as the drain oil passage) RAd is configured to connect between the advance chambers 202 and the oil discharge portion OD through the advance openings OA, the drain recess 660, the sleeve drain hole 402, the rotor drain hole 310 and the drain port PD (not shown).

The partition PRsd is formed at an end portion of the drain recess 660 located on the spool sealing portion 61 side in the spool 60. The partition PRsd partitions between the retard drain oil passage RRd and the retard supply oil passage RRs.

The partition PAsd is formed at an end portion of the drain recess 660 located on the spool sealing portion 62 side in the spool 60. The partition PAsd partitions between the advance drain oil passage RAd and the advance supply oil passage RAs.

The recycle oil passage Rre connects between the advance drain oil passage RAd at the drain recess 660 and the retard supply oil passage RRs at the inside space of the spool 60 through the recycle opening Ore (not shown).

Furthermore, the recycle oil passage Rre connects between the retard drain oil passage RRd at the drain recess 660 and the advance supply oil passage RAs at the inside space of the spool 60 through the recycle opening Ore (see FIG. 10).

In the present embodiment, the drain flow restrictor AD corresponds to the sleeve drain hole 402. Specifically, the drain flow restrictor AD is formed at the sleeve 400. The drain flow restrictor AD is configured to communicate between the inside and the outside of the sleeve 400. The drain flow restrictor AD extends through a wall of the sleeve 400 in the radial direction, and the number of the drain flow restrictor AD is one all around the sleeve 400 in the circumferential direction. Here, the sleeve 400 corresponds to a tubular member.

As described above, the drain flow restrictor AD is formed in the retard drain oil passage (serving as the drain oil passage) RRd and the advance drain oil passage (serving as the drain oil passage) RAd at the location between: the partition PRsd or the partition PAsd; and the drain port PD.

A passage cross-sectional area of the drain flow restrictor AD is smaller than a smallest passage cross-sectional area of the recycle oil passage Rre and is constant regardless of a relative position of the spool 60 relative to the sleeve 400. Here, the passage cross-sectional area of the drain flow restrictor AD corresponds to a cross-sectional area of the drain flow restrictor AD, i.e., the sleeve drain hole 402, which is perpendicular to an axis of the sleeve drain hole 402. Furthermore, the smallest passage cross-sectional area of the recycle oil passage Rre corresponds to a sum of cross-sectional areas of the recycle openings Ore of the recycle oil passage Rre, each of which is perpendicular to an axis of the recycle opening Ore. The passage cross-sectional area of the drain port PD is larger than the passage cross-sectional area of the drain flow restrictor AD, i.e., the sleeve drain hole 402.

In the present embodiment, the drain flow restrictor AD, i.e., the sleeve drain hole 402 has a passage cross-section that is shaped in a form of a circle.

In the present embodiment, an orifice diameter of the drain flow restrictor AD, i.e., a diameter of the sleeve drain hole 402 is set to be in a range of 1.5 mm to 2.5 mm. Specifically, the passage cross-sectional area of the drain flow restrictor AD is set to be in a range of 1.77 $mm^2$ to 4.91 $mm^2$.

As described above, in the present embodiment, the hydraulic oil controller OC includes the sleeve 400 which serves as the tubular member that is shaped in the tubular form. The retard drain oil passage (serving as the drain oil passage) RRd and the advance drain oil passage (serving as the drain oil passage) RAd extend on the radially outer side (the rotor drain hole 310) and the radially inner side (the drain recess 660) of the sleeve 400. The drain flow restrictor AD extends through the wall of the sleeve 400 in the radial direction and connects between the drain oil passage located on the radially outer side of the sleeve 400 and the drain oil passage located on the radially inner side of the sleeve 400. As described above, the connection hole (the sleeve drain hole 402) of the drain oil passage, which extends on the inner side and the outer side of the sleeve 400 shaped in the tubular form, is formed as the drain flow restrictor AD so that the drain flow restrictor AD can be easily formed.

Other Embodiments

In another embodiment, the passage cross-sectional area of the drain flow restrictor may be set to be smaller than 1.77 $mm^2$ or larger than 4.91 $mm^2$.

Furthermore, in another embodiment, the passage cross-section of the drain flow restrictor should not be limited to the form of the circle and may be any form such as an oval, a rectangular, or a polygon.

In another embodiment, the housing 20 and the crankshaft 2 may be connected by a transmission member, such as a belt, in place of the chain 6.

Furthermore, in another embodiment, the vane rotor 30 may be fixed to the end portion of the crankshaft 2, and the housing 20 may be rotated synchronously with the camshaft 3.

Furthermore, in another embodiment, the valve timing adjustment device 10 may adjust the valve timing of the exhaust valves 5 of the engine 1.

As discussed above, the present disclosure should not be limited to the above embodiments and can be implemented in various forms without departing from the scope thereof.

The present disclosure has been described with reference to the embodiments. However, the present disclosure should not be limited to the embodiments and the structures described above. The present disclosure covers various modifications and variations on the scope of equivalents. Also, various combinations and forms as well as other combinations, each of which includes only one element or more or less of the various combinations, are also within the scope and spirit of the present disclosure.

What is claimed is:

1. A valve timing adjustment device configured to adjust a valve timing of a valve of an internal combustion engine, comprising:

a phase shifter that includes a retard chamber and an advance chamber, wherein the phase shifter is configured to adjust the valve timing of the valve by shifting a rotational phase between a drive shaft and a driven shaft of the internal combustion engine with hydraulic oil supplied from a hydraulic oil supply source to the retard chamber and the advance chamber; and a hydraulic oil controller that is configured to control a flow of the hydraulic oil supplied to the retard chamber and the advance chamber by controlling the hydraulic oil flowing in a retard supply oil passage, which connects between the hydraulic oil supply source and the retard chamber, and the hydraulic oil flowing in an advance supply oil passage, which connects between the hydraulic oil supply source and the advance chamber, wherein:

the hydraulic oil controller includes:

a drain port that is connected to an oil discharge portion that is configured to store the hydraulic oil discharged from the retard chamber or the advance chamber;

a partition that is configured to partition between a drain oil passage and a corresponding one of the retard supply oil passage and the advance supply oil passage, wherein the drain oil passage connects between the oil discharge portion and a corresponding one of the retard chamber and the advance chamber;

a recycle oil passage that connects between:

a portion of the drain oil passage located between the partition and the drain port; and the retard supply oil passage or the advance supply oil passage; and a drain flow restrictor that is formed in the drain oil passage at a location between the partition and the drain port, wherein a passage cross-sectional area of the drain flow restrictor is smaller than a smallest passage cross-sectional area of the recycle oil passage and is constant.

2. The valve timing adjustment device according to claim 1, wherein the drain oil passage and the recycle oil passage are connected to the partition that is common to the drain oil passage and the recycle oil passage.

3. The valve timing adjustment device according to claim 1, wherein:

the hydraulic oil controller includes a tubular member that is shaped in a tubular form;

the drain oil passage is formed on both of a radially outer side and a radially inner side of the tubular member; and the drain flow restrictor extends through a wall of the tubular member in a radial direction and connects between a portion of the drain oil passage located on the radially outer side of the tubular member and another portion of the drain oil passage located on the radially inner side of the tubular member.

4. The valve timing adjustment device according to claim 1, wherein:

the hydraulic oil controller includes:

a sleeve which is shaped in a tubular form; and a spool which is shaped in a tubular form and is configured to reciprocate in an axial direction at an inside of the sleeve to control the flow of the hydraulic oil to be supplied to the retard chamber and the advance chamber; and the drain flow restrictor is formed at only one of the spool and the sleeve.

5. The valve timing adjustment device according to claim 4, wherein:

the drain flow restrictor is formed at the spool; and a space at an inside of the spool is connected to the drain port.

6. The valve timing adjustment device according to claim 4, wherein the drain flow restrictor is formed at the sleeve.

7. The valve timing adjustment device according to claim 1, wherein the passage cross-sectional area of the drain flow restrictor is set to be in a range of 1.77 $mm^2$ to 4.91 $mm^2$.

8. The valve timing adjustment device according to claim 1, wherein the drain flow restrictor has a passage cross-section that is shaped in a form of a circle.

* * * * *